US010041763B2

(12) United States Patent
Chavez

(10) Patent No.: US 10,041,763 B2
(45) Date of Patent: Aug. 7, 2018

(54) MULTI-FUNCTION GUNSIGHT

(71) Applicant: Bushnell Inc., Overland Park, KS (US)

(72) Inventor: Alejandro Chavez, Overland Park, KS (US)

(73) Assignee: Bushnell Inc., Overland Park, KS (US)

( * ) Notice: Subject to any disclaimer, the term of this patent is extended or adjusted under 35 U.S.C. 154(b) by 0 days.

(21) Appl. No.: 15/639,111

(22) Filed: Jun. 30, 2017

(65) Prior Publication Data

US 2018/0003462 A1 Jan. 4, 2018

Related U.S. Application Data

(60) Provisional application No. 62/357,732, filed on Jul. 1, 2016.

(51) Int. Cl.

| | |
|---|---|
| ***F41G 1/35*** | (2006.01) |
| ***F41G 1/033*** | (2006.01) |
| ***F41G 3/08*** | (2006.01) |

(52) U.S. Cl.

CPC ..... *F41G 1/35* (2013.01); *F41G 1/033* (2013.01); *F41G 3/08* (2013.01)

(58) Field of Classification Search

CPC ..... F41G 1/033; F41G 1/35

See application file for complete search history.

(56) References Cited

U.S. PATENT DOCUMENTS

| | | | |
|---|---|---|---|
| 4,686,770 | A | 8/1987 | Aigner |
| 5,063,677 | A | 11/1991 | Millett |
| 5,193,099 | A | 3/1993 | Chou |
| 5,307,253 | A | 4/1994 | Jehn |
| 5,343,376 | A | 8/1994 | Huang |
| 5,533,292 | A | 7/1996 | Swan |
| 5,584,569 | A | 12/1996 | Huang |
| 5,784,823 | A | 7/1998 | Chen |
| 5,791,766 | A | 8/1998 | Lee |
| 5,803,582 | A | 9/1998 | Hunag |
| 5,838,639 | A | 11/1998 | Hwang |
| 5,918,374 | A | 7/1999 | Campbell et al. |

(Continued)

OTHER PUBLICATIONS

"Barska Front Sight with Integrated Red Laser Sight", https://www.amazon.com/Barska-Front-Sight-Integrated-Laser/dp/B00A7AB8GI, Feb. 2, 2013.*

*Primary Examiner* — Stephen Johnson
*Assistant Examiner* — Joshua T Semick
(74) *Attorney, Agent, or Firm* — Christensen, Fonder, Dardi & Herbert PLLC

(57) ABSTRACT

A multi-function gunsight for aiming a firearm comprises a body and a sight arm pivotally coupled to the body for rotation between a stowed orientation and a deployed orientation. The body defining a laser cavity, a starboard cavity, and a port cavity. A laser housing is disposed inside the laser cavity defined by the body. The laser housing supports a semiconductor chip that emits laser light and a collimating lens that collimates the laser light emitted by the semiconductor chip. A forward end of the laser housing is coupled to a spherical bearing. The spherical bearing constrains movement of the laser housing in three translation degrees of freedom corresponding to translation along x, y, and z axes of an x-y-z coordinate system. The spherical bearing allows rotation of the laser housing about at least the x and y axes of the x-y-z coordinate system.

20 Claims, 26 Drawing Sheets

(56) References Cited

U.S. PATENT DOCUMENTS

| | | | | |
|---|---|---|---|---|
| 5,993,026 | A | 11/1999 | Wu | |
| 6,066,052 | A | 5/2000 | Li | |
| 7,472,830 | B2 | 1/2009 | Danielson | |
| 7,926,218 | B2 | 4/2011 | Matthews et al. | |
| 8,015,744 | B1 | 9/2011 | Swan | |
| 8,037,634 | B2 | 10/2011 | Price | |
| 8,191,302 | B1 * | 6/2012 | Swan | F41G 1/04 362/110 |
| 8,484,882 | B2 * | 7/2013 | Haley | F41G 1/02 42/111 |
| 9,267,759 | B2 * | 2/2016 | Speroni | F41C 27/00 |
| 9,297,614 | B2 | 3/2016 | Moore | |

* cited by examiner

MULTI-FUNCTION GUNSIGHT

CROSS-REFERENCE TO RELATED APPLICATION

This application claims the benefit of U.S. Provisional Patent Application No. 62/357,732, filed Jul. 1, 2016, the disclosure of which is incorporated by reference herein.

BACKGROUND OF THE DISCLOSURE

Weapon-mounted firearm accessories have become an important tool for military, police, militia, and civilian firearm users. Examples of popular firearm accessories include targeting devices, such as LASER sighting devices, and target illuminators, such as flashlights. Many firearm designs incorporate mounting rails for supporting these accessories. Using an accessory rail interface, a given accessory may be mounted to a variety of firearms or firearms platforms. Likewise, if a particular firearm includes a rail interface, a variety of accessories may be interchangeably mounted to the firearm. The interchangeability of accessories is of particular importance to military and law enforcement personnel attached to special operations units, as this allows a single firearm to be reconfigured to meet certain mission specific needs.

A number of weapon-mounted firearm accessories can be used to facilitate aiming the weapon. Laser sights for weapons permit a user to aim a weapon by projecting a light beam onto a target. Laser sights permit a user to quickly aim a weapon without viewing the target through a scope or other sighting device. This also permits the user to aim and shoot from any number of other firing positions, such as permitting the user to shoot from the hip. If the laser sight is properly sighted for the distance and wind conditions involved, a projectile, such as a bullet, arrow or shot, from a weapon will strike the desired target where the light dot generated by the laser sight shines on the target.

Laser sights are not, however, without problems. For example, although laser sights work well in low light conditions, in bright light conditions laser sights occasionally perform poorly because ambient light can overwhelm the dot generated on the target by the laser light source, making the dot difficult or impossible for the user to see. A laser sight also uses a relatively large amount of power, so the battery life for a laser sight is typically relatively short.

Examples of electronic sights for weapons include reflex sights and holographic sights. Electronic sights use a light source to project a narrow beam of light onto a specially coated lens. The lens reflects the light to the eye of the user, and the user sees the light as a small, colored dot on the lens. The user aims the weapon by viewing the target through the lens and positioning the dot on the target. If the electronic sight is properly zeroed or sighted for the distance and wind conditions involved, a projectile from the weapon will strike the target at the position on the target covered by the dot on the lens. Electronic sights offer many advantages over conventional sights in any number of firing situations. For example, typical telescopic sights require a user's eye to be carefully aligned behind the scope and require a particular eye relief, requiring the user's eye to be a particular distance from the scope lens, typically around three inches. This makes scopes difficult to aim quickly, difficult to use while tracking a moving target and difficult or impossible to use with weapons such as pistols or bows. Electronic sights overcome these problems in that they do not require any particular eye relief and do not require, relatively speaking, the careful alignment of the user's eye relative to the lens. If the user can see the light dot reflected from the lens, the user can aim the weapon, and a projectile fired from a properly sighted weapon will strike the target at the point on the target covered by the light dot on the lens, regardless of the alignment of the user's eye relative to the lens.

Electronic sights are also not without problems. For example, electronic sights still require a user to view a target through a lens and, therefore, do not offer the aiming flexibility discussed above in connection with laser sights. As with a laser and other sights, an electronic sight is zeroed or sighted for a particular distance, and adjustments in the field are also typically inconvenient or impractical. Electronic sights also have the potential to stop functioning in the field. For example, the battery of the electronic sight may become depleted.

SUMMARY

A multi-function gunsight for aiming a firearm comprises a body and a sight arm pivotally coupled to the body for rotation between a stowed orientation and a deployed orientation. The body defining a laser cavity, a starboard cavity, and a port cavity. A laser housing is disposed inside the laser cavity defined by the body. The laser housing supports a semiconductor chip that emits laser light and a collimating lens that collimates the laser light emitted by the semiconductor chip. A forward end of the laser housing is coupled to a spherical bearing. The spherical bearing constrains movement of the laser housing in three translation degrees of freedom corresponding to translation along x, y, and z axes of an x-y-z coordinate system. The spherical bearing allows rotation of the laser housing about at least the x and y axes of the x-y-z coordinate system. The spherical bearing comprising a ball and that is received in a bearing cup.

The multi-function gunsight includes a windage adjustment mechanism comprising a windage adjustment spring and a windage adjustment screw that is threadingly received in a windage adjustment insert. The windage adjustment insert includes a windage adjustment shoulder that is positioned and configured to limit travel of the windage adjustment screw. The windage adjustment spring is positioned and configured to bias the laser housing against the windage adjustment screw. The windage adjustment screw is positioned and configured so that rotation of the windage adjustment screw relative to the windage adjustment insert produces rotation of the laser housing about the y-axis.

The multi-function gunsight also includes an elevation adjustment mechanism comprising an elevation adjustment spring and an elevation adjustment screw that is threadingly received in an elevation adjustment insert. The elevation adjustment insert includes an elevation adjustment shoulder positioned and configured to limit travel of the elevation adjustment screw. The elevation adjustment spring is positioned and configured to bias the laser housing against the elevation adjustment screw. The elevation adjustment screw is positioned and configured so that rotation of the elevation adjustment screw relative to the elevation adjustment insert produces rotation of the laser housing about the x-axis.

In some embodiments, a starboard switch is disposed in the starboard cavity defined by the body of the multi-function gunsight. The starboard switch comprises a starboard switch substrate overlaying a bottom surface of the starboard cavity, a starboard switch spring overlaying the starboard switch substrate, and a starboard switch cap overlaying the starboard switch spring. The starboard switch substrate comprises first and second conductive traces disposed on a starboard facing surface thereof. The starboard switch spring is deformable between an unstressed configuration in which an inner surface of the starboard switch spring is concave and a deformed configuration in which the starboard switch spring completes an electrical circuit between the first conductive trace and the second conductive trace of the starboard switch substrate. The starboard switch spring is positioned and configured to assume the deformed configuration when a portwardly directed depressing force is applied to the starboard switch cap.

In some embodiments, a starboard switch is disposed in the starboard cavity defined by the body of the multi-function gunsight. The starboard switch comprises a starboard switch substrate overlaying a bottom surface of the starboard cavity, a starboard switch spring overlaying the starboard switch substrate, and a starboard switch cap overlaying the starboard switch spring. The starboard switch substrate comprises first and second conductive traces disposed on a starboard facing surface thereof. The starboard switch spring is deformable between an unstressed configuration in which an inner surface of the starboard switch spring is concave and a deformed configuration in which the starboard switch spring completes an electrical circuit between the first conductive trace and the second conductive trace of the starboard switch substrate. The starboard switch spring is positioned and configured to assume the deformed configuration when a portwardly directed depressing force is applied to the starboard switch cap.

In some embodiments, a port switch is disposed in the port cavity defined by the body of the multi-function gunsight. The port switch comprises a port switch substrate overlaying a bottom surface of the port cavity, a port switch spring overlaying the port switch substrate, and a port switch cap overlaying the port switch spring. The port switch substrate comprises first and second conductive traces disposed on a portwardly facing surface thereof. The port switch spring is deformable between an unstressed configuration in which an inner surface of the port switch spring is concave and a deformed configuration in which the port switch spring completes an electrical circuit between the first conductive trace and the second conductive trace of the port switch substrate. The port switch spring is positioned and configured to assume the deformed configuration when a starboardly directed depressing force is applied to the port switch cap.

In one or more embodiments, a multi-function gunsight for aiming a firearm is disclosed. The firearm may have a barrel defining a bore, the bore extending along a gun bore axis BA. In the figures, the gun bore axis BA is shown extending in a forward direction and rearward direction. In one or more embodiments, the multi-function gunsight comprises a Y-shaped body having three legs, a forwardly extending leg defining a laser cavity and two rearwardly extending legs pivotally supporting a sight arm. The two rearwardly extending legs may include a port leg and a starboard leg. A pin may extend though the sight arm, the port leg and the starboard leg. The sight arm may be pivotally supported by the pin so that the sight arm pivots about a sight arm pivot axis PA between a deployed position and a reclined position.

A battery housing multi-function gunsight may be fixed to one of the lateral sides (port and starboard) of the Y-shaped body. The battery housing defines a battery compartment disposed on one lateral side (port or starboard) of the Y-shaped body in some embodiments. A windage adjustment mechanism of the multi-function gunsight may be positioned opposite the battery compartment. In some embodiments, the battery compartment is disposed portward of the laser cavity defined by the forwardly extending leg of the body and the windage adjustment mechanismW is disposed on a starboard side of the forwardly extending leg of the body. In other embodiments, the battery compartment is disposed starboard of the laser cavity defined by the forwardly extending leg of the body and the windage adjustment mechanism is disposed on a port side of the forwardly extending leg of the body.

The battery compartment may be dimensioned and adapted to receive a battery. In some embodiments, the battery compartment is dimensioned and adapted to receive a battery of the size known as CR123A. The battery may comprise, for example, a CR123A lithium battery. In one or more embodiments, the battery compartment is disposed forward of the sight arm pivot axis PA. In one or more embodiments, a forward-most end of the battery compartment is disposed forward of a forward-most end of the laser cavity.

In one or more embodiments, a laser unit of the multi-function gunsight is disposed inside the laser cavity. The laser unit may generate a laser beam extending in a forward direction along a laser beam axis LA. In one or more embodiments, the laser beam axis LA is generally parallel to the gun bore axis BA of the firearm. In one or more embodiments, the laser unit is disposed forward of the sight arm pivot axis PA.

In one or more embodiments, a elevation adjustment mechanism of the multi-function gunsight is positioned opposite the battery compartment and the battery housing. The elevation adjustment mechanism may selective rotate the laser unit about a elevation axis X. In one or more embodiments, the elevation axis X extends in portward and starboard directions. In one or more embodiments, the elevation adjustment mechanism is disposed forward of the sight arm pivot axis PA. In one or more embodiments, a windage adjustment mechanism of the multi-function gunsight is positioned opposite the battery compartment and the battery housing. The windage adjustment mechanism may selective rotate the laser unit about a windage axis Y. In one or more embodiments, the windage axis Y extends in upward and downward directions. In one or more embodiments, the windage adjustment mechanism is disposed forward of the sight arm pivot axis PA.

In one or more embodiments, the sight arm of the multi-function gunsight comprises a sighting element extending a along a sighting element axis SA. In one or more embodiments, the sighting element axis SA extends in the forward and rearward directions when the sight arm is in the reclined position and the sighting element axis SA extends in the upward and downward directions when the sight arm is in the deployed position. In one or more embodiments, the sighting element is disposed rearward of the sight arm pivot axis PA when the sight arm is in the reclined position and the sighting element is disposed upward of the sight arm pivot axis PA when the sight arm is in the deployed position. In one or more embodiments, the sighting element is generally aligned with the sight arm pivot axis PA along an axis extending in forward and rearward directions when the sight arm is in the deployed position. In one or more embodiments, the sighting element axis SA, the laser beam axis LA, and the gun bore axis BA are all generally coplanar when the sight arm is in the reclined position. When the sight arm is in the deployed position, the user may aim the firearm with reference to a sight line SL extending through the sighting element. In one or more embodiments, the sight line SL, the laser beam axis LA, and the gun bore axis BA are all generally coplanar when the sight arm is in the deployed position. In one or more embodiments, the sight line SL, the laser beam axis LA, and the gun bore axis BA are all generally parallel to each other when the sight arm is in the deployed position. In one or more embodiments, the sighting element axis SA, the laser beam axis LA, and the gun bore axis BA are all generally parallel to each other when the sight arm is in the reclined position.

DETAILED DESCRIPTION

Figure 1:
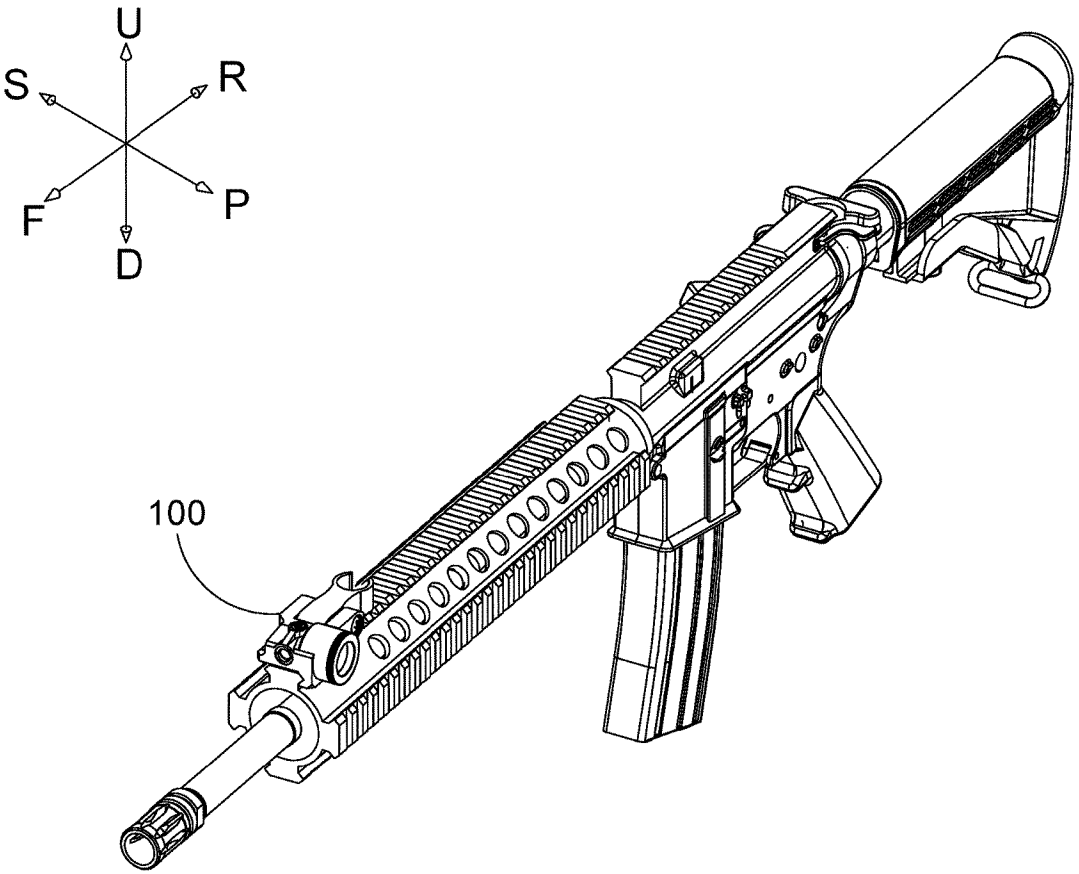
FIG. 1 is a perspective view showing a firearm and a multi-function gunsight in accordance with the detailed description.
Figure 2:
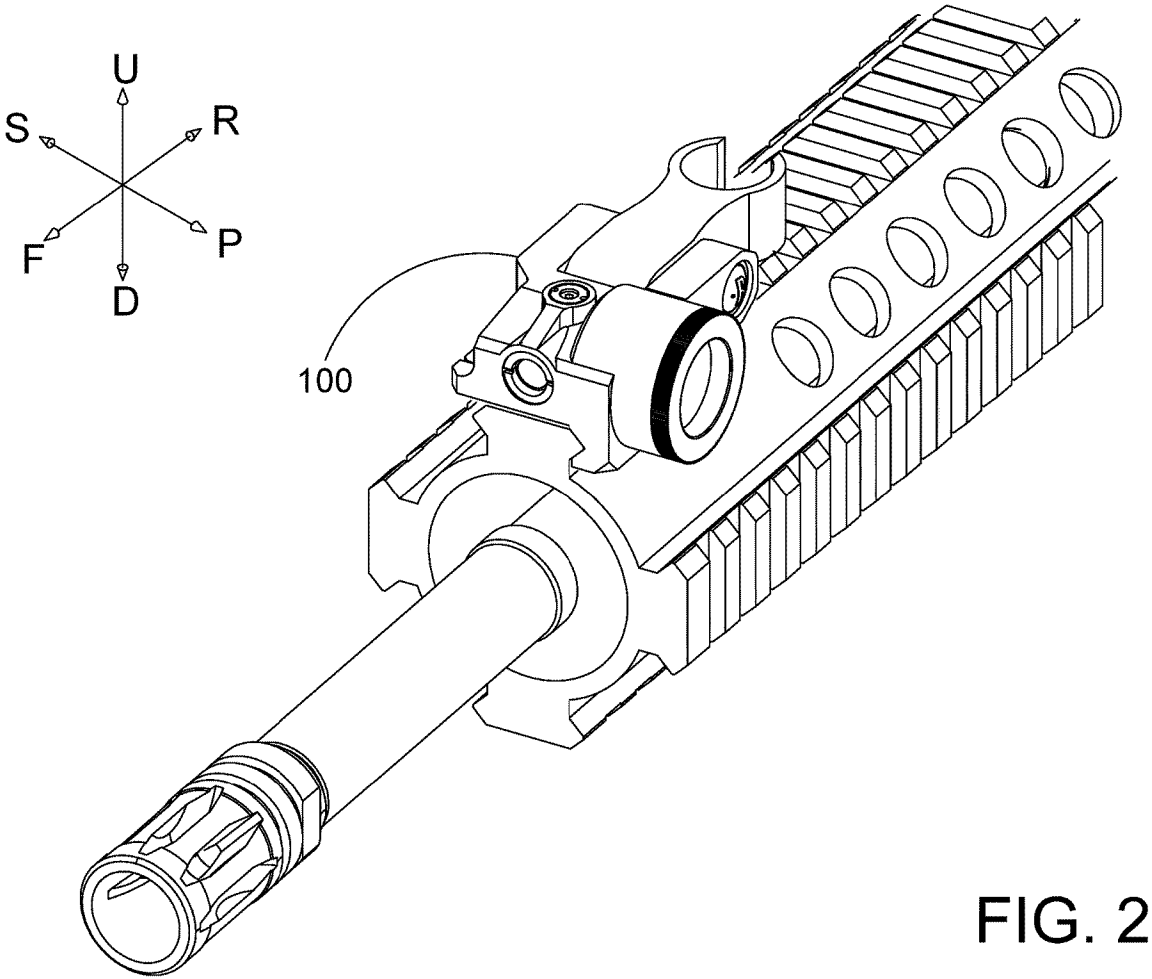
FIG. 2 is a perspective view showing a portion of a firearm and a multi-function gunsight in accordance with the detailed description.
Figure 3:
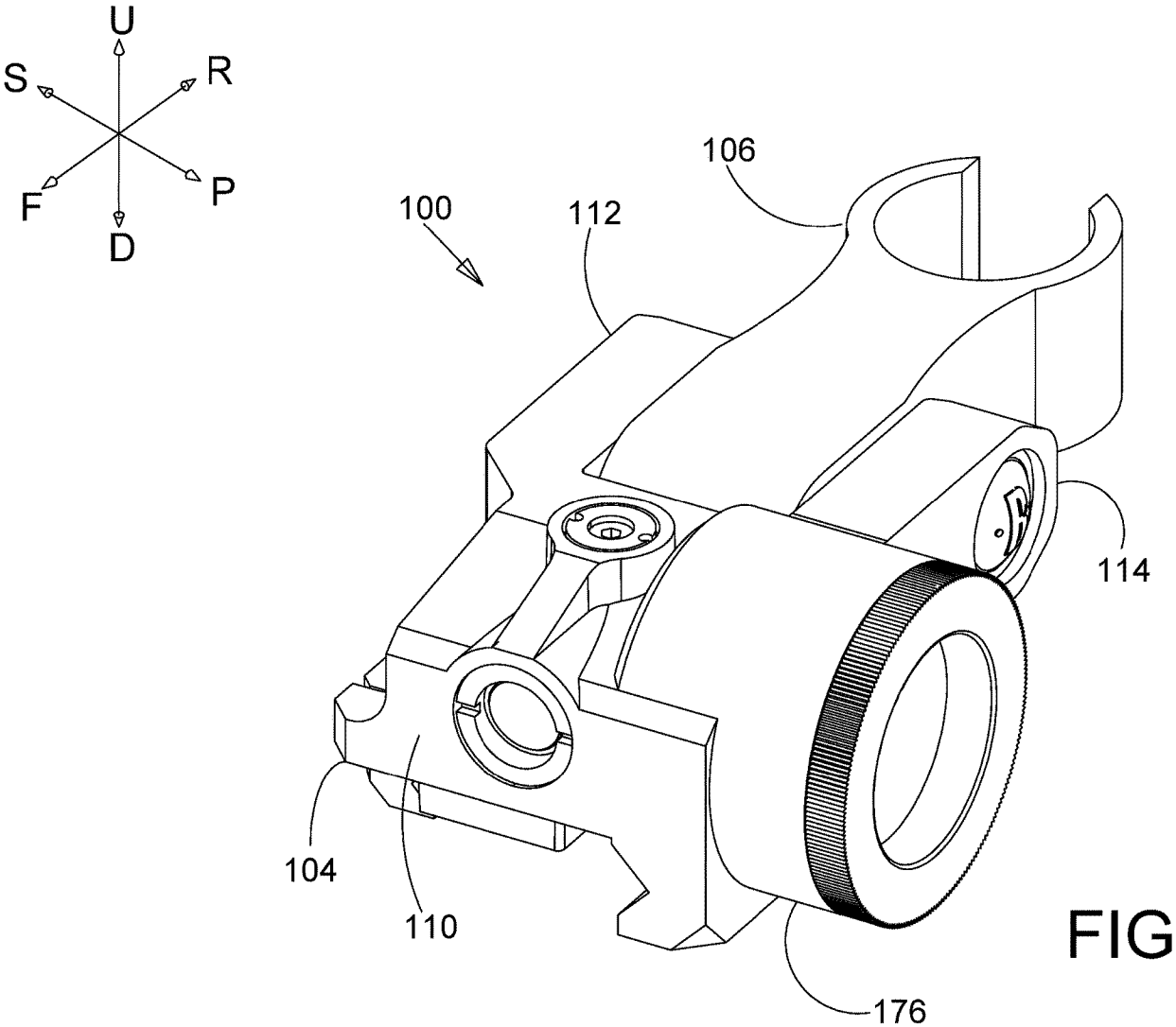
FIG. 3 is a perspective view showing a multi-function gunsight in accordance with the detailed description.
Figure 4:
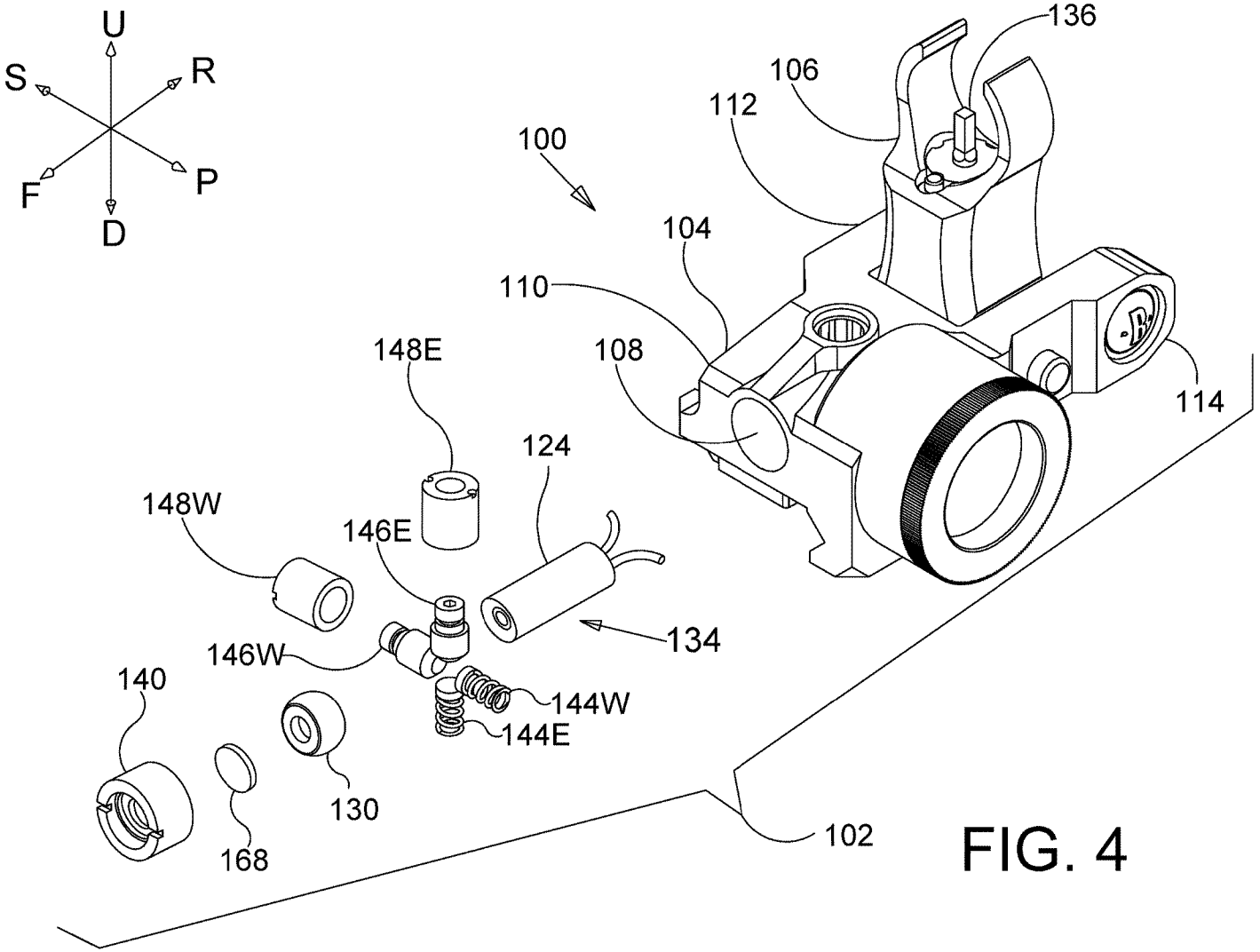
FIG. 4 is a partially exploded view showing a multi-function gunsight in accordance with the detailed description.
Figure 5:
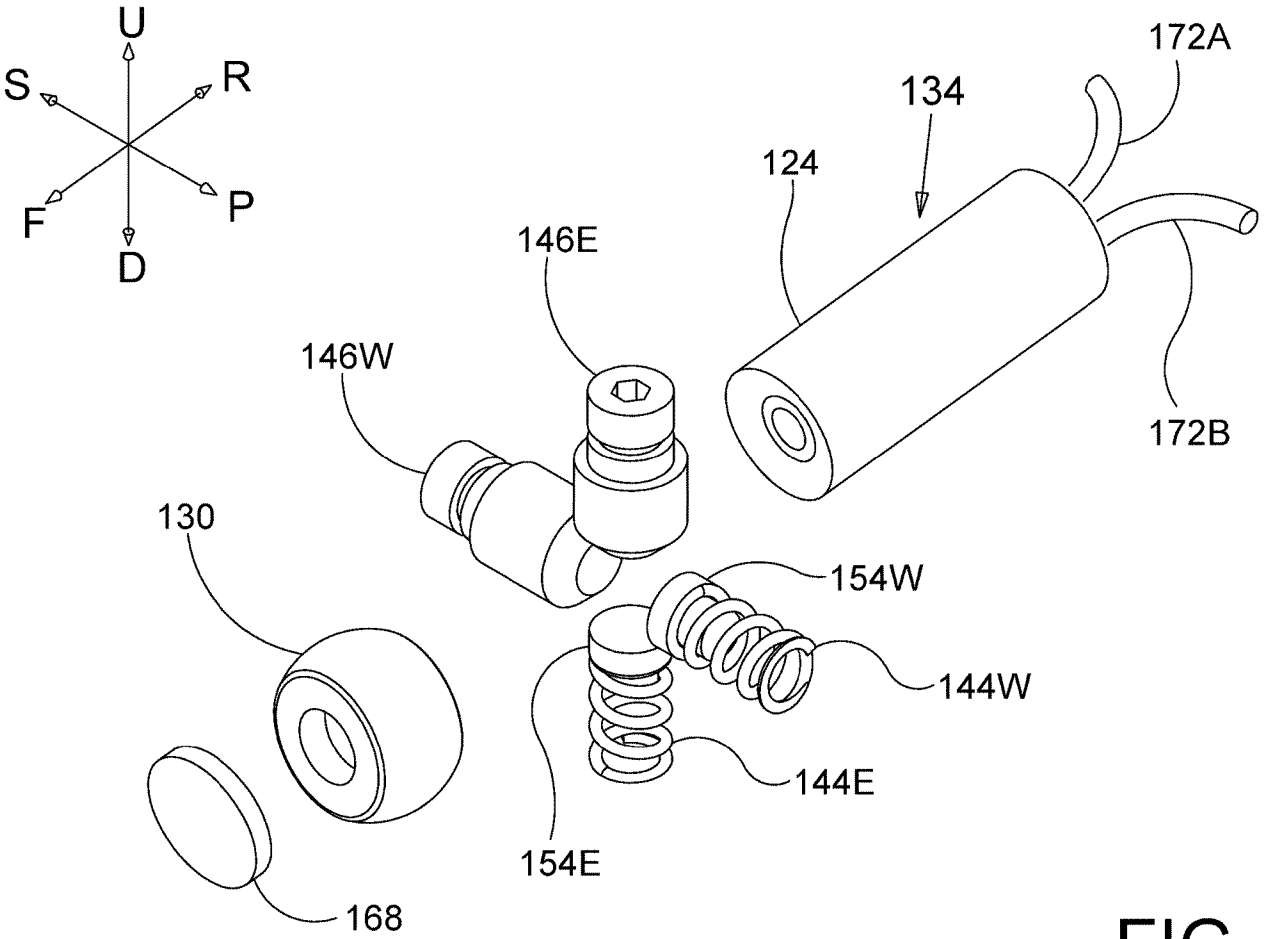
FIG. 5 is an enlarged exploded view further illustrating the multi-function gunsight shown in FIG. 4.

Referring to FIGS. 1-25, a multi-function gunsight 100 for aiming a firearm comprises a gunsight assembly 102 including a body 104 and a sight arm 106 pivotally coupled to the body 104 for rotation between a stowed orientation and a deployed orientation. The body 104 defines a laser cavity 108, a starboard cavity 120, and a port cavity 122. A laser unit xx is disposed inside the laser cavity 108 defined by the body 104. The laser unit xx comprises a laser housing 124. The laser housing 124 supports a semiconductor chip 126 that emits laser light and a lens 128 that collimates the laser light emitted by the semiconductor chip 126. A forward end of the laser housing 124 is coupled to a spherical bearing 130. The spherical bearing 130 constrains movement of the laser housing in three translation degrees of freedom corresponding to translation along x, y, and z axes of an x-y-z coordinate system. The spherical bearing 130 allows rotation of the laser housing 124 about at least the x and y axes of the x-y-z coordinate system. The spherical bearing 130 comprises a spherical surface 132 and that is received in a bearing cup 140. Laser light may pass through a window 168.

The multi-function gunsight 100 includes a windage adjustment mechanism 142W comprising a windage adjustment spring 144W and a windage adjustment screw 146W that is threadingly received in a windage adjustment insert 148W. The windage adjustment insert 148W includes a windage adjustment shoulder 150W that is positioned and configured to limit travel of the windage adjustment screw 146W. The windage adjustment spring 144W is positioned and configured to bias the laser housing 124 against the windage adjustment screw 146W. The windage adjustment screw 146W is positioned and configured so that rotation of the windage adjustment screw 146W relative to the windage adjustment insert 148W produces rotation of the laser housing 124 about the y-axis.

The multi-function gunsight 100 also includes an elevation adjustment mechanism 142E comprising an elevation adjustment spring 144E and an elevation adjustment screw 146E that is threadingly received in an elevation adjustment insert 148E. The elevation adjustment insert 148E includes an elevation adjustment shoulder 150E positioned and configured to limit travel of the elevation adjustment screw 146E. The elevation adjustment spring 144E is positioned and configured to bias the laser housing 124 against the elevation adjustment screw 146E. The elevation adjustment screw 146E is positioned and configured so that rotation of the elevation adjustment screw 146E relative to the elevation adjustment insert 148E produces rotation of the laser housing 124 about the x-axis. A laser sight may be adjusted or sighted for a particular distance and wind condition.

In some embodiments, a starboard switch 152S is disposed in the starboard cavity 120 defined by the body 104 of the multi-function gunsight 100. The starboard switch 152S comprises a starboard switch substrate 156S overlaying a bottom surface of the starboard cavity 120, a starboard switch spring 158S overlaying the starboard switch substrate 156S, and a starboard switch cap 160S overlaying the starboard switch spring 158S. The starboard switch substrate 156S comprises a first conductive trace 162S and a second conductive trace 164S disposed on a starboard facing surface 166S of the starboard switch substrate 156S. The starboard switch spring 158S is deformable between an unstressed configuration in which an inner surface of the starboard switch spring is concave and a deformed configuration in which the starboard switch spring completes an electrical circuit between the first conductive trace 162S and the second conductive trace 164S of the starboard switch substrate 156S. The starboard switch spring 158S is positioned and configured to assume the deformed configuration when a portwardly directed depressing force is applied to the starboard switch cap 160S.

In some embodiments, a port switch 152P is disposed in the port cavity 122 defined by the body 104 of the multi-function gunsight 100. The port switch 152P comprises a port switch substrate 156P overlaying a bottom surface of the port cavity 122, a port switch spring 158P overlaying the port switch substrate 156P, and a port switch cap 160P overlaying the port switch spring 158P. The port switch substrate 156P comprises a first conductive trace 162P and a second conductive trace 164P disposed on a portwardly facing surface 166P of the port switch substrate 156P. The port switch spring 158P is deformable between an unstressed configuration in which an inner surface of the port switch spring is concave and a deformed configuration in which the port switch spring completes an electrical circuit between the first conductive trace 162P and the second conductive trace 164P of the port switch substrate 156P. The port switch spring 158P is positioned and configured to assume the deformed configuration when a starboardly directed depressing force is applied to the port switch cap 160P.

Figure 11:
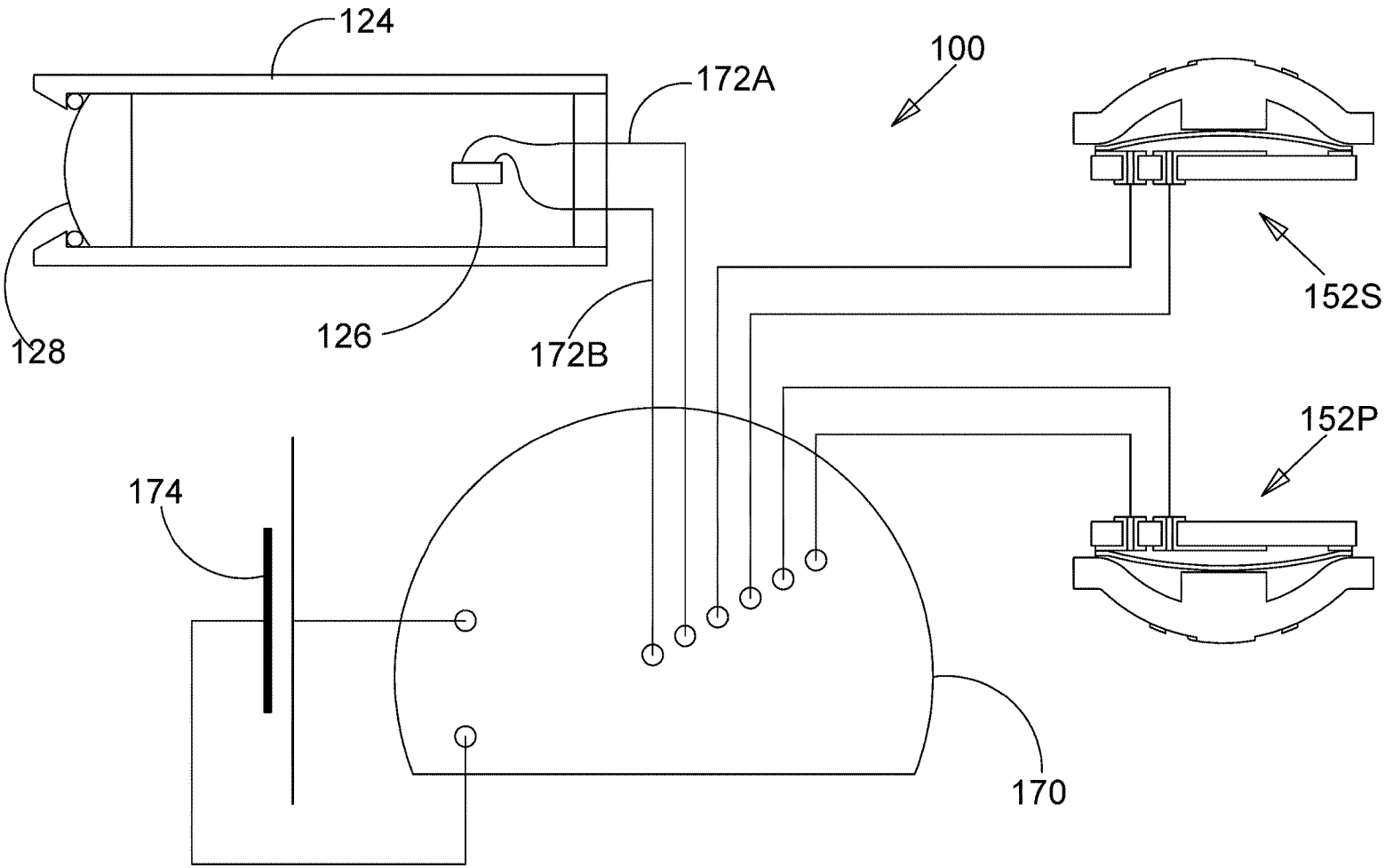
FIG. 11 is a diagram further illustrating the structure of a multi-function gunsight in accordance with the detailed description.
Figure 12A:
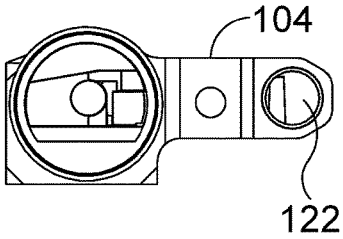
FIGS. 12A through 12F are side views showing the body of a multi-function gunsight in accordance with the detailed description.
Figure 12B:
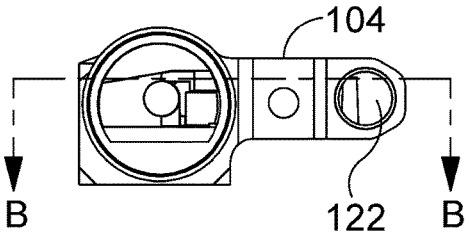
Figure 12C:
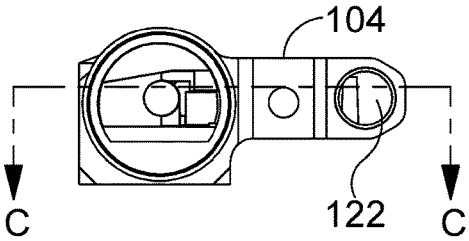
Figure 12D:
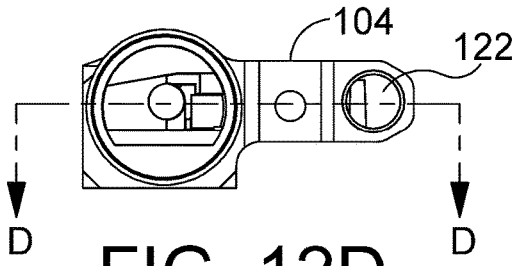
Figure 12E:
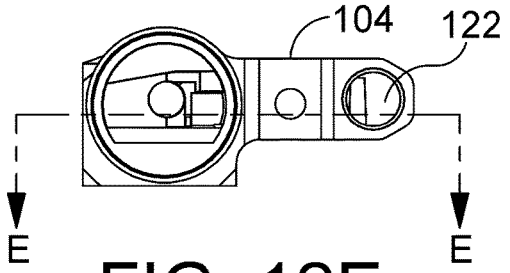
Figure 12F:
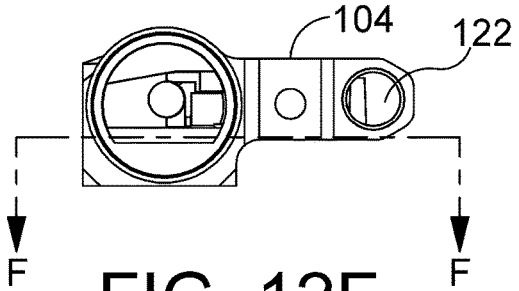

Referring to FIG. 11, a multi-function gunsight 100 for aiming a firearm comprises a laser housing 124, a starboard switch 152S and a port switch 152P. The laser housing 124 supports a semiconductor chip 126 that emits laser light and a lens 128 that collimates the laser light emitted by the semiconductor chip 126. The semiconductor chip 126 is electrically connected to a printed wiring board 170 by a first lead wire 172A and a second lead wire 172B. A battery 174 is connected to the printed wiring board 170 to provide power for the multi-function gunsight 100.

The starboard switch 152S comprises a first conductive trace 162S and a second conductive trace 164S disposed on a starboard facing surface 166S of a starboard switch substrate 156S. The first conductive trace 162S is electrically connected to the printed wiring board by a first switch wire. The second conductive trace 164S is electrically connected to the printed wiring board by a second switch wire. The port switch 152P comprises a first conductive trace 162P and a second conductive trace 164P disposed on a portward facing surface 166P of a port switch substrate 156P. The first conductive trace 162P is electrically connected to the printed wiring board by a first switch wire. The second conductive trace 164P is electrically connected to the printed wiring board by a second switch wire.

Figure 13A:
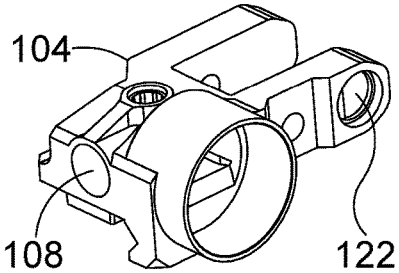
FIGS. 13A through 13F are perspective views showing the body of a multi-function gunsight in accordance with the detailed description.
Figure 13B:
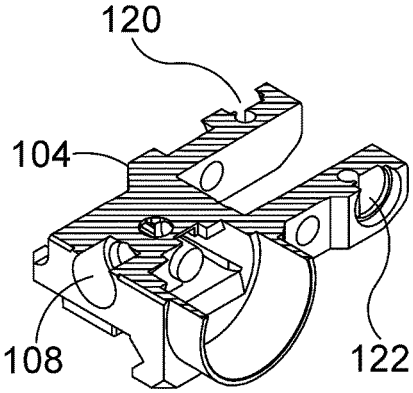
Figure 13C:
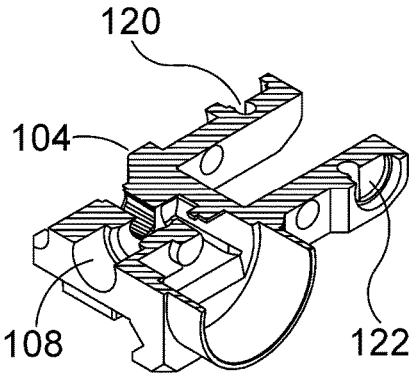
Figure 13D:
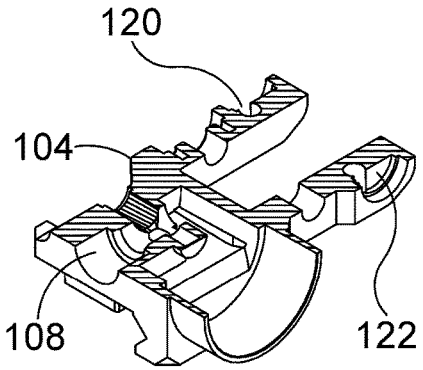
Figure 13E:
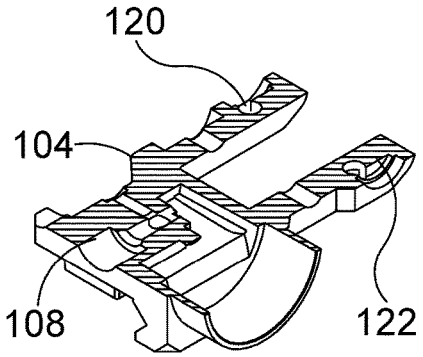
Figure 13F:
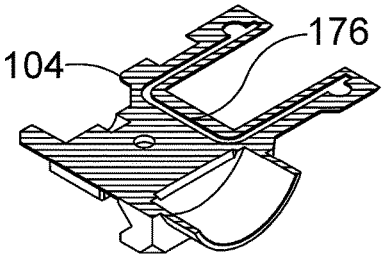

Referring to FIGS. 12A through 13F, the body 104 of a multi-function gunsight in accordance with this detailed description is shown. FIGS. 12A through 12F are side views showing the body 104 and FIGS. 13A through 13F are perspective views showing the body 104. The body 104 defines a laser cavity 108, a starboard cavity 120, and a port cavity 122. In the embodiment of FIG. 13B, the body 104 has been sectioned along section line B-B shown in FIG. 12B. In the embodiment of FIG. 13C, the body 104 has been sectioned along section line C-C shown in FIG. 12C. In the embodiment of FIG. 13D, the body 104 has been sectioned along section line D-D shown in FIG. 12D. In the embodiment of FIG. 13E, the body 104 has been sectioned along section line E-E shown in FIG. 12E. In the embodiment of FIG. 13F, the body 104 has been sectioned along section line F-F shown in FIG. 12F. With reference to FIG. 12F, it will be appreciated that body 104 defines a channel 176. In some embodiments, channel 176 fluidly communicates with the laser cavity 108, the starboard cavity 120, and the port cavity 122. In some embodiments, a multifunction gunsight 100 may include wires extending between the laser cavity 108, the starboard cavity 120, and/or the port cavity 122 via the channel 176.

Figure 14A:
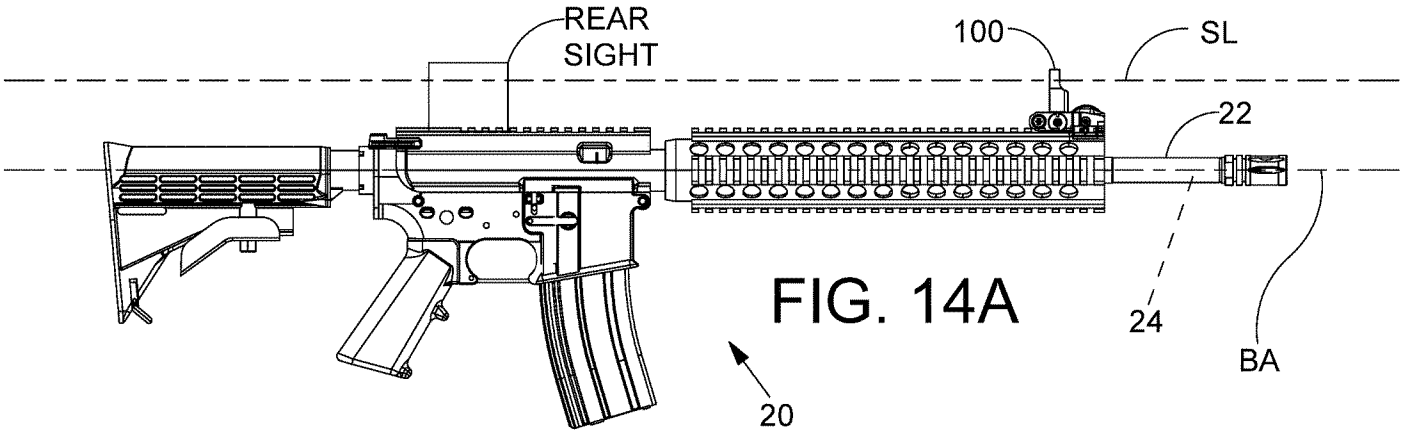
FIGS. 14A and 14B are side views showing a firearm and a multi-function gunsight in accordance with the detailed description. In the embodiment of FIG. 14A, the gunsight is in an upright, deployed state. In the embodiment of FIG. 14B, the gunsight is in a laid down, stowed state.
Figure 14B:
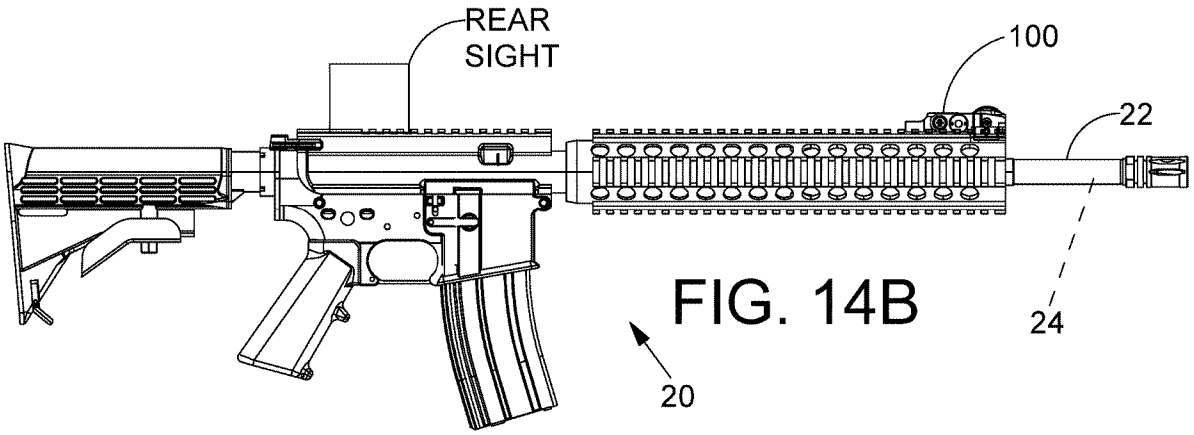

FIGS. 14A and 14B are side views showing a firearm and a multi-function gunsight 100 in accordance with the detailed description. In the embodiment of FIG. 14A, the gunsight 100 is in an upright, deployed state. In the embodiment of FIG. 14B, the gunsight 100 is in a laid down, stowed state. The multi-function gunsight 100 comprises a body and a sight arm that is pivotally coupled to the body for rotation between a stowed orientation and a deployed orientation.

Figure 15A:
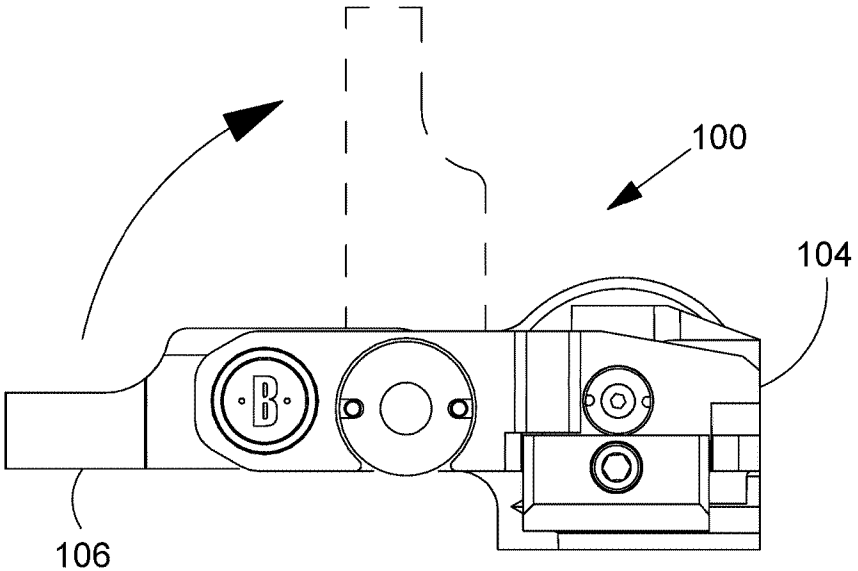
FIGS. 15A and 15B are side views showing a multi-function gunsight in accordance with the detailed description. In the embodiment of FIG. 15A, the gunsight is in a laid down, stowed state. In the embodiment of FIG. 15B, the gunsight is in an upright, deployed state.
Figure 15B:
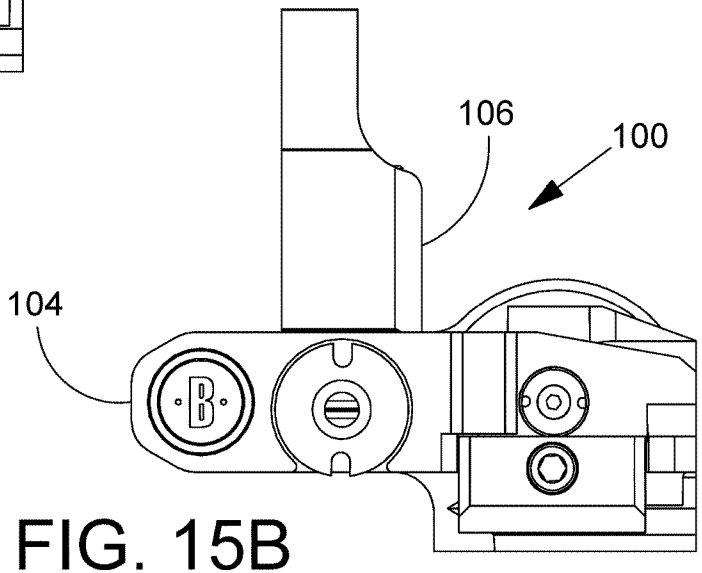

FIGS. 15A and 15B are side views showing a multi-function gunsight 100 in accordance with the detailed description. In the embodiment of FIG. 15A, the gunsight 100 is in a laid down, stowed state. In the embodiment of FIG. 15B, the gunsight 100 is in an upright, deployed state. The gunsight 100 comprises a body 104 and a sight arm 106 that is pivotally coupled to the body 104 for rotation between a laid down, stowed orientation and a deployed orientation. In the embodiment of FIG. 15A, the sight arm 106 is in the laid down, stowed orientation. The deployed orientation of the sight arm 106 is shown with dashed lines in FIG. 15A. In the embodiment of FIG. 15B, the sight arm 106 is in the upright, deployed orientation.

Figure 16D:
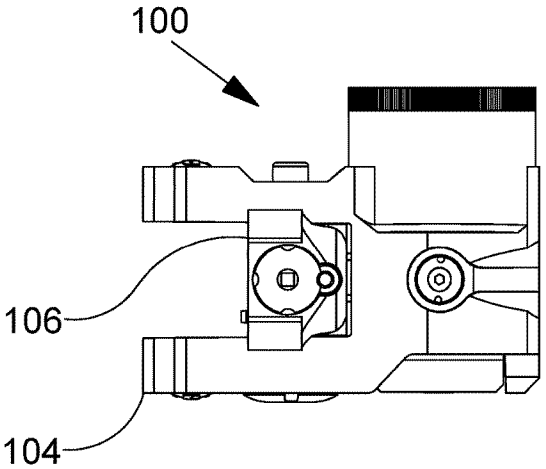
FIG. 16D is a top view of the gunsight shown in FIG. 16C.
Figure 16C:
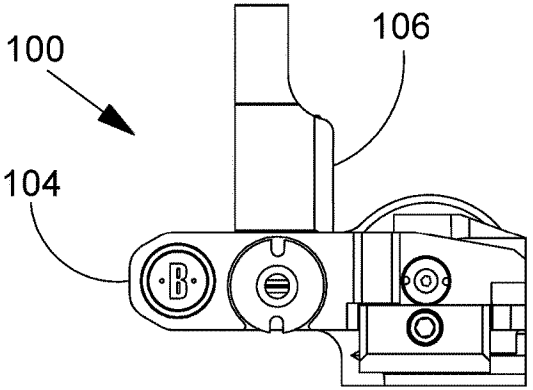
FIG. 16C is a side view of a gunsight in an upright, deployed state.
Figure 16B:
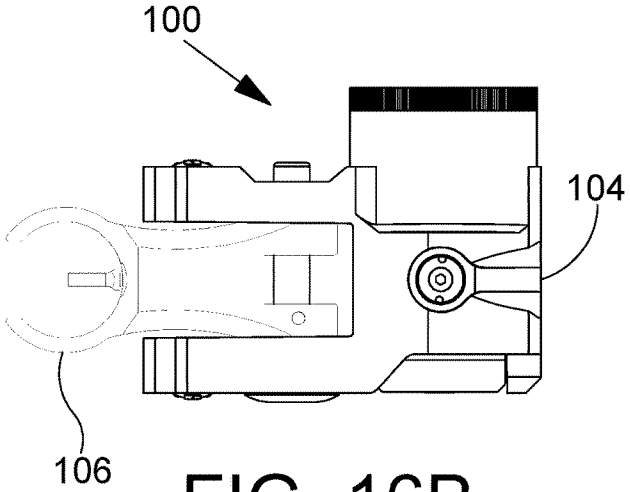
FIG. 16B is a top view of the gunsight shown in FIG. 16A.
Figure 16A:
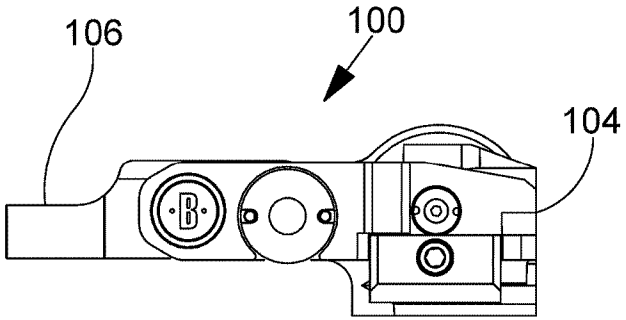
FIG. 16A is a side view of a gunsight in a laid down, stowed state.

FIG. 16A is a side view of a gunsight 100 in a laid down, stowed state. FIG. 16B is a top view of the gunsight 100 shown in FIG. 16A. The gunsight 100 comprises a body 104 and a sight arm 106 that is pivotally coupled to the body 104 for rotation between a laid down, stowed orientation and a deployed orientation. In the embodiment of FIG. 16A, the sight arm 106 is in the laid down, stowed orientation.

FIG. 16C is a side view of a gunsight 100 in an upright, deployed state. FIG. 16D is a top view of the gunsight 100 shown in FIG. 16C. The gunsight 100 comprises a body 104 and a sight arm 106 that is pivotally coupled to the body 104 for rotation between a laid down, stowed orientation and a deployed orientation. In the embodiment of FIG. 16C, the sight arm 106 is in the upright, deployed orientation.

Figure 17B:
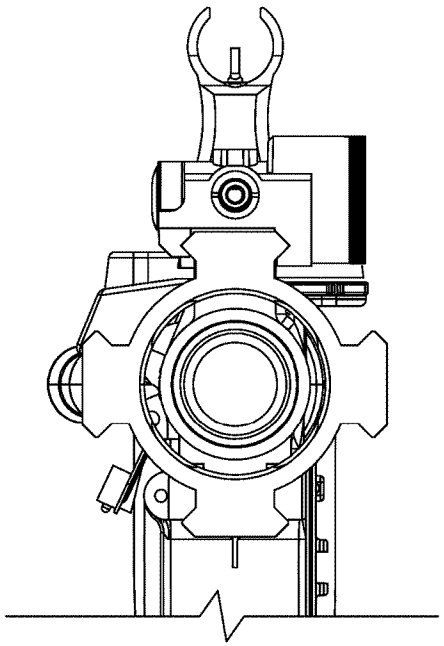
FIG. 17B is a front view showing a gunsight detachably attached to a mounting rail of a firearm.
Figure 17A:
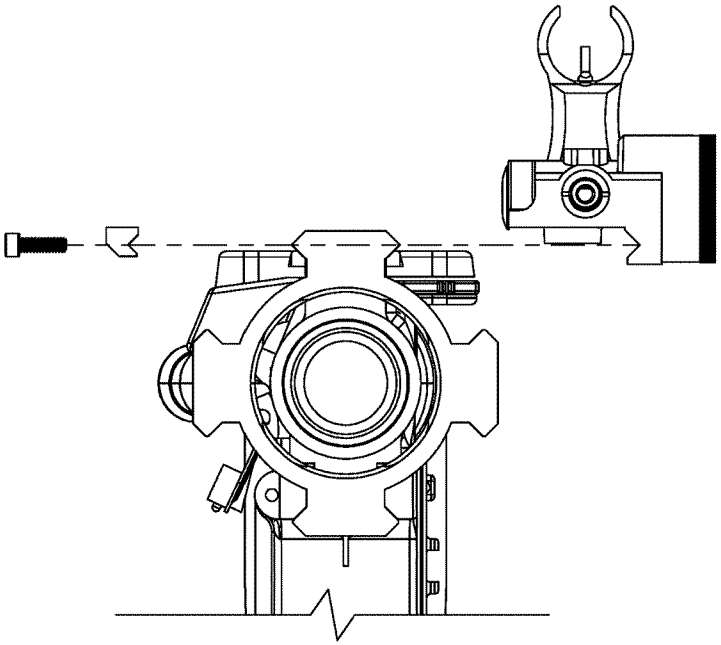
FIG. 17A is a partially exploded front view showing a gunsight configured to be detachably attached to a mounting rail of a firearm.
Figure 18:
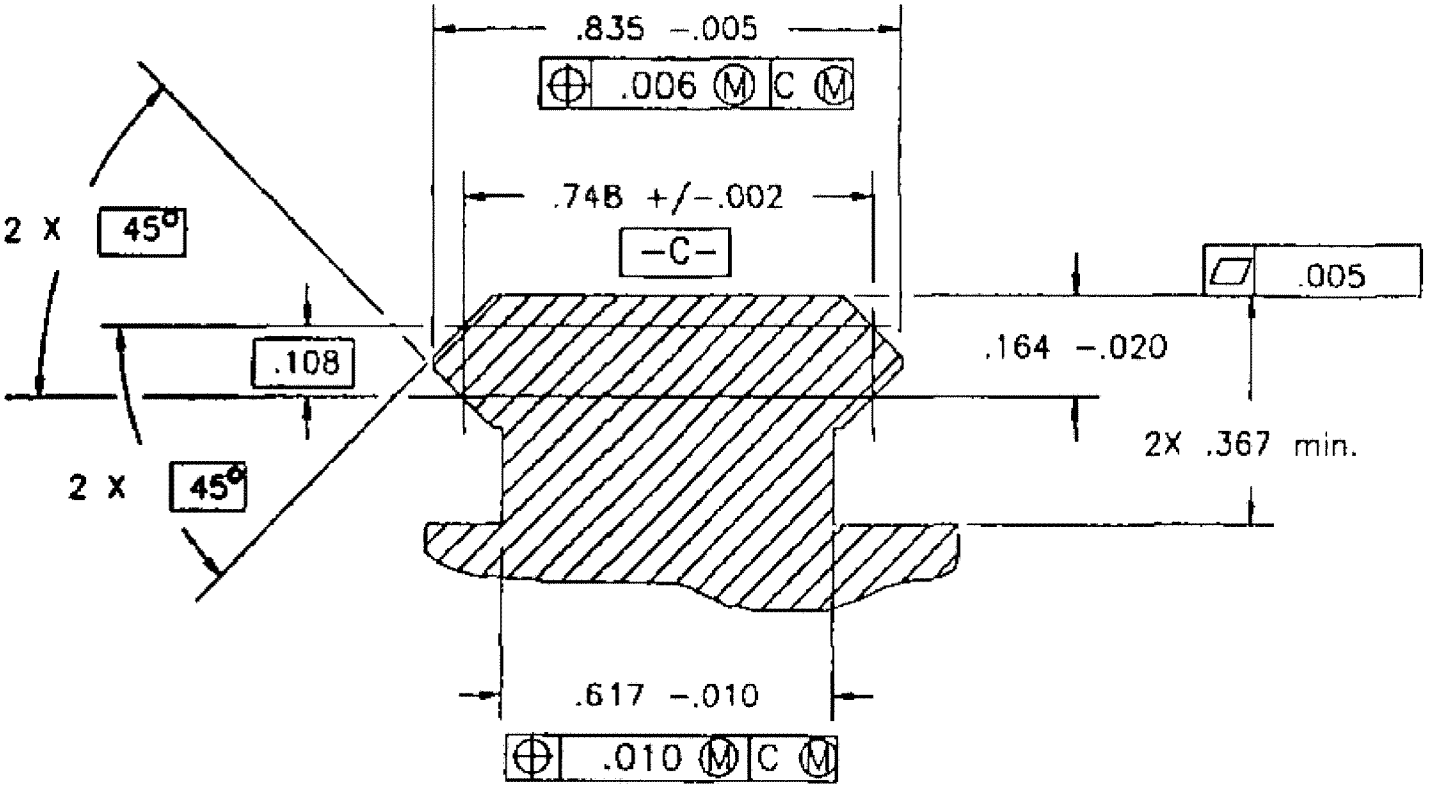
FIG. 18 PRIOR ART
FIG. 18 is a reproduction of a mounting rail drawing from Military Standard MIL-STD-1913 dated 3 Feb. 1995.

FIG. 17A is a partially exploded front view showing a gunsight 100 configured to be detachably attached to a mounting rail of a firearm. The body 104 of the gunsight 100 includes a mounting portion that is dimensioned and configured to mate with a mounting rail, such as, for example, a Picatinny rail and/or a Weaver rail. FIG. 18 is a reproduction of a mounting rail drawing from Military Standard MIL-STD-1913 dated 3 Feb. 1995. The gunsight 100 also includes a clamp member and a screw. A mounting rail may clamped between the camp member and the mounting portion of the body 104 by tightening the screw. FIG. 17B is a front view showing a gunsight 100 detachably attached to a mounting rail of a firearm.

Figure 19A:
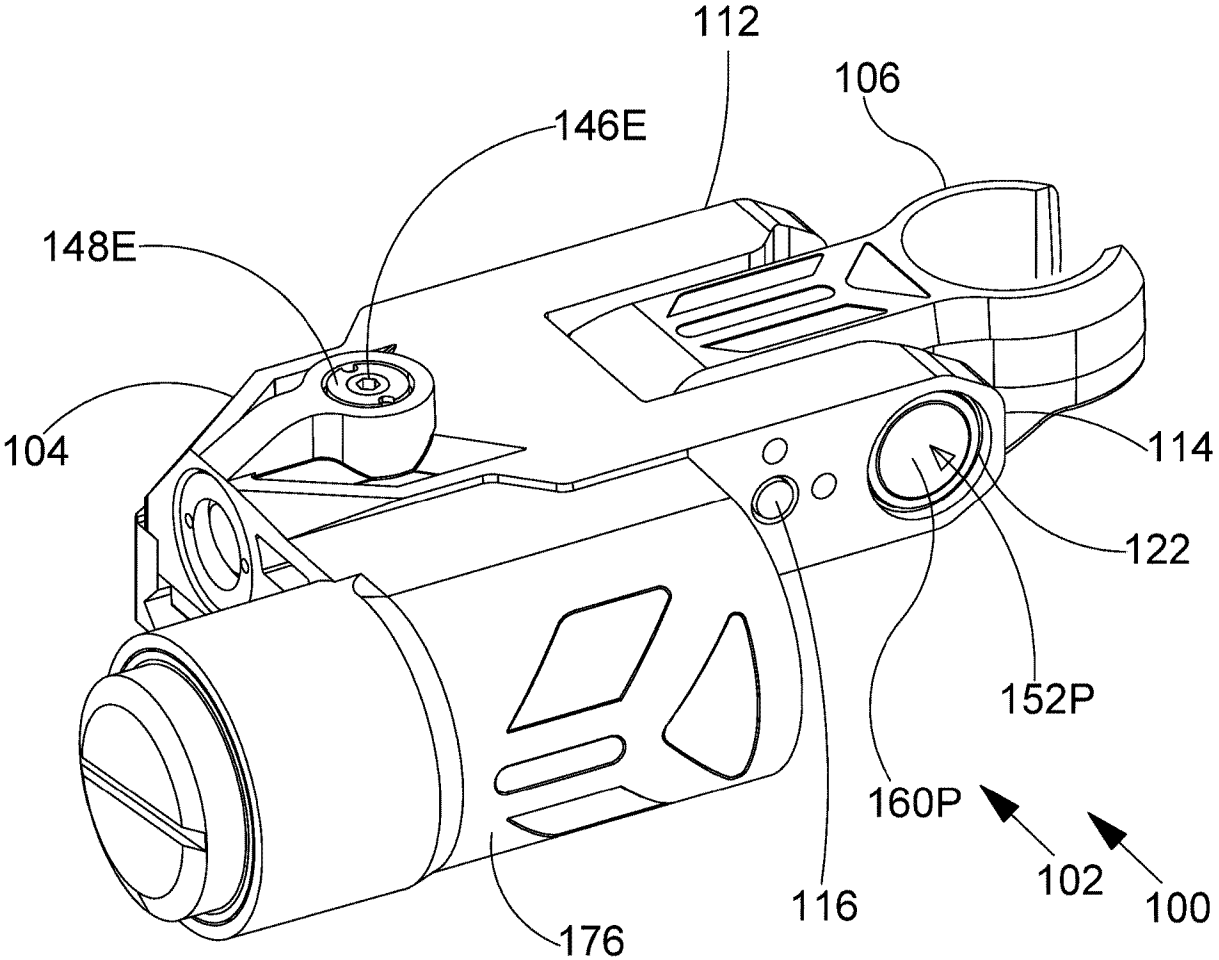
FIG. 19A and FIG. 19B are perspective views showing a multi-function gunsight in accordance with the detailed description.
Figure 19B:
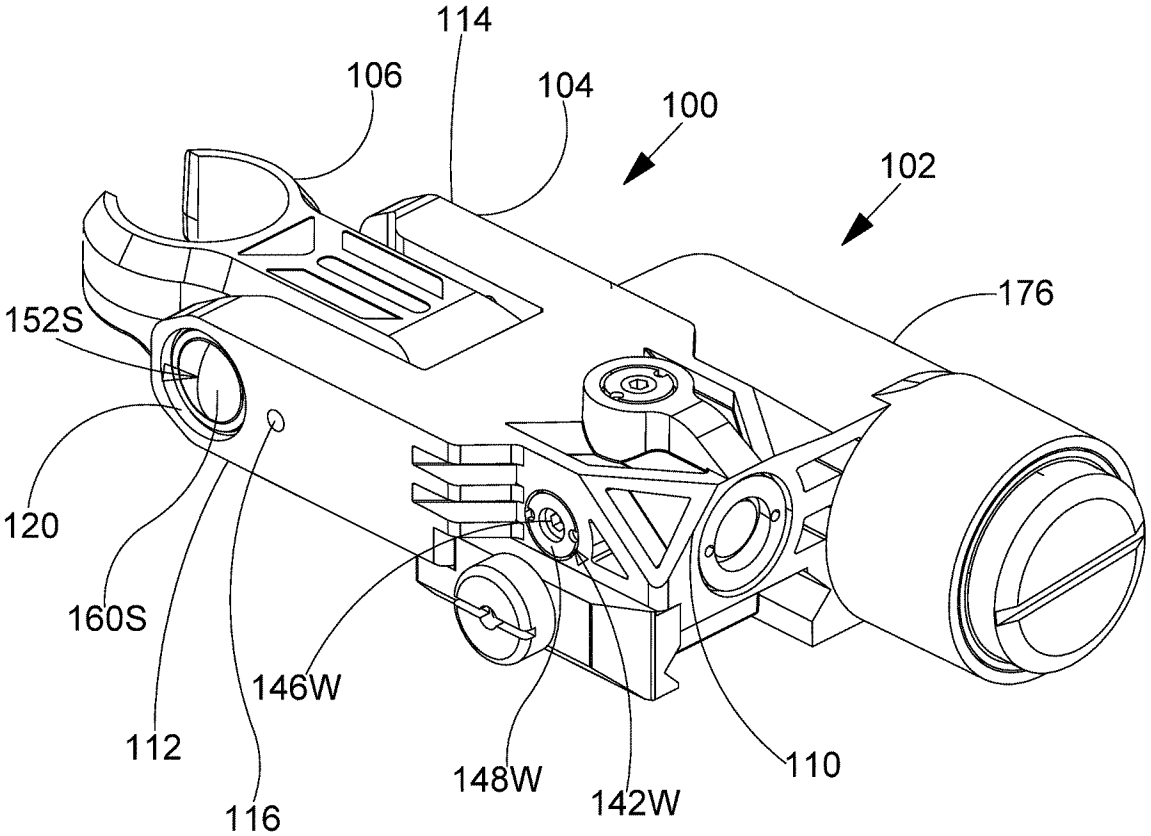
Figure 20:
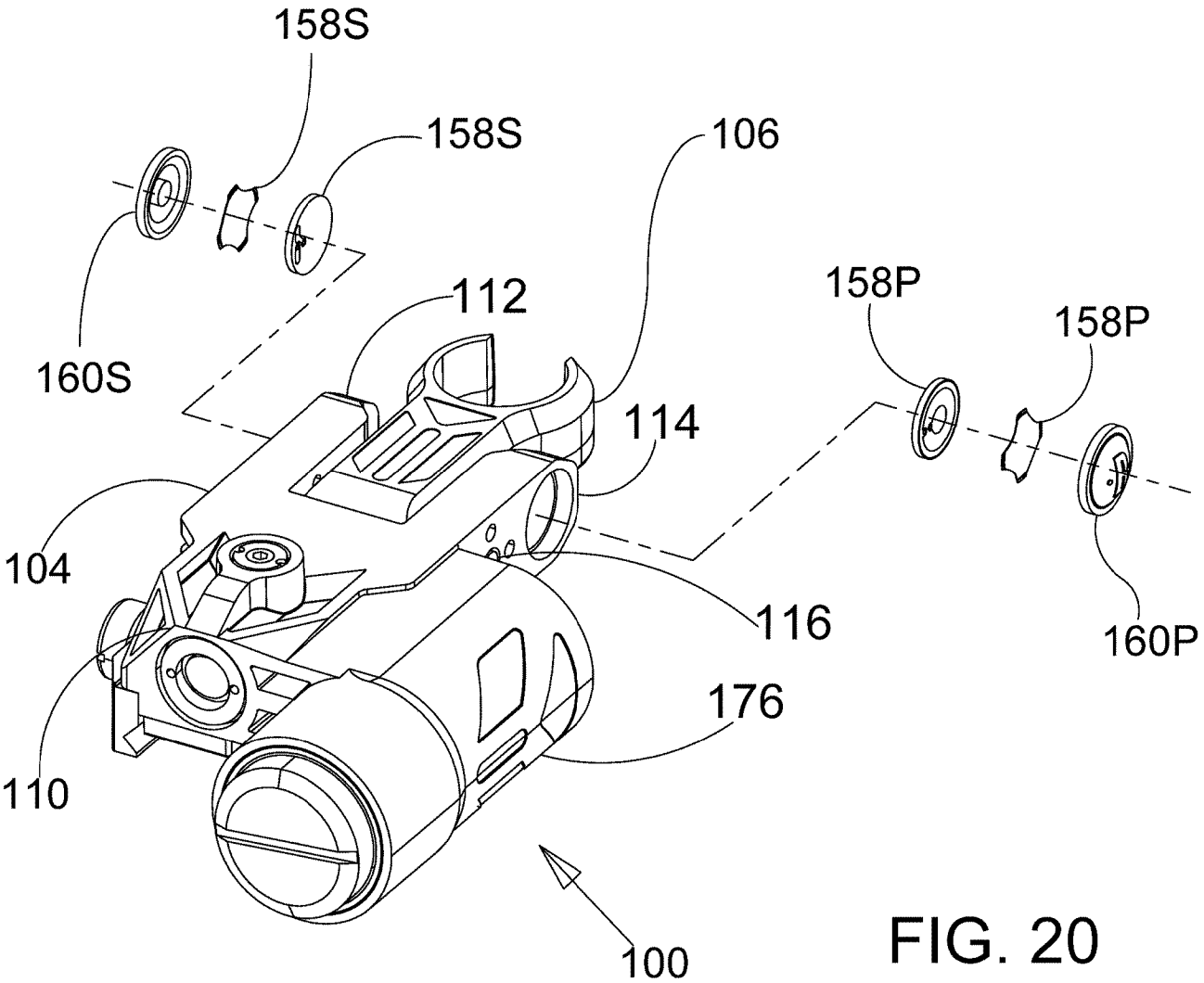
FIG. 20 is a partially exploded view showing a multi-function gunsight in accordance with the detailed description.
Figure 21:
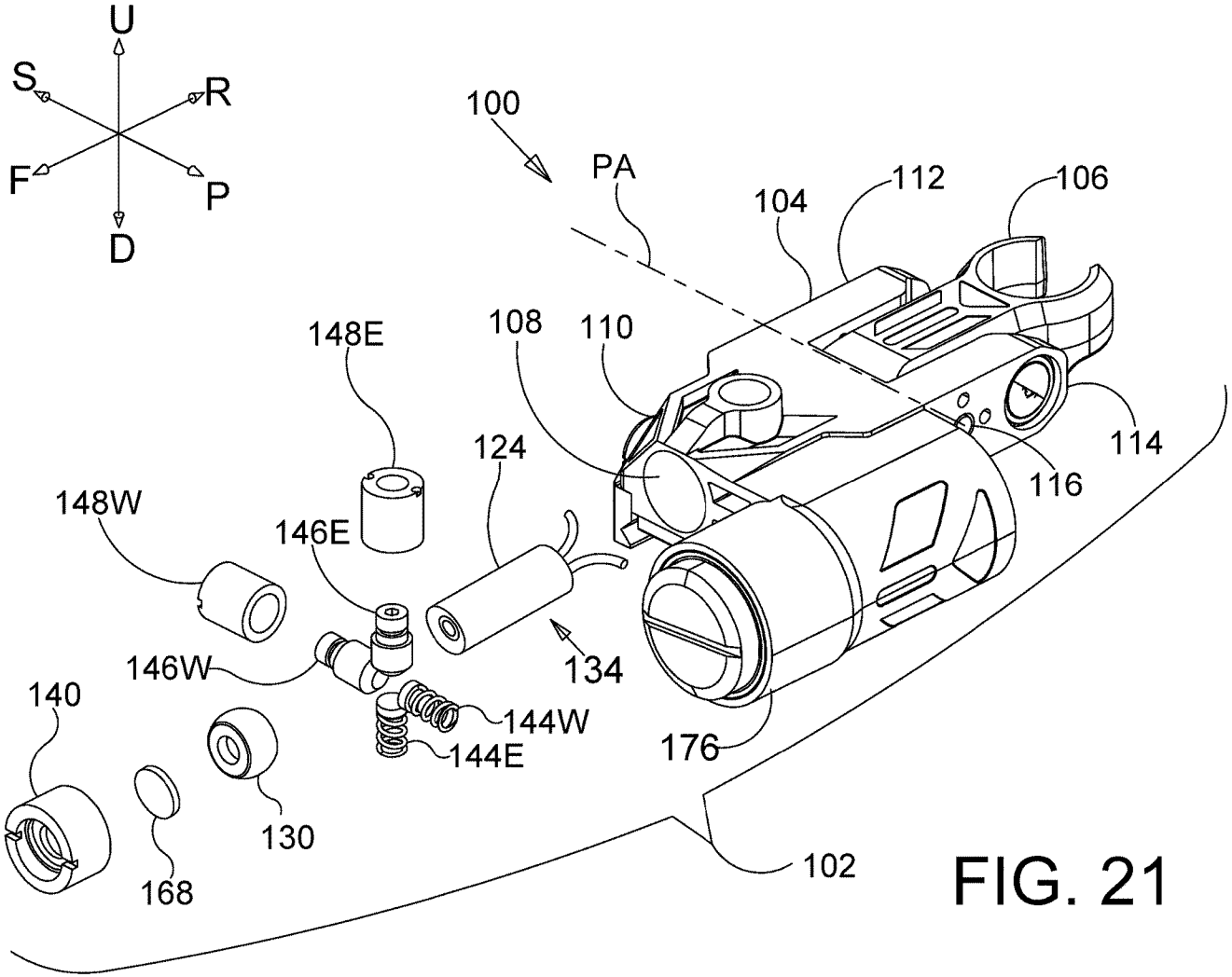
FIG. 21 is a partially exploded view showing a multi-function gunsight in accordance with the detailed description.
Figure 22:
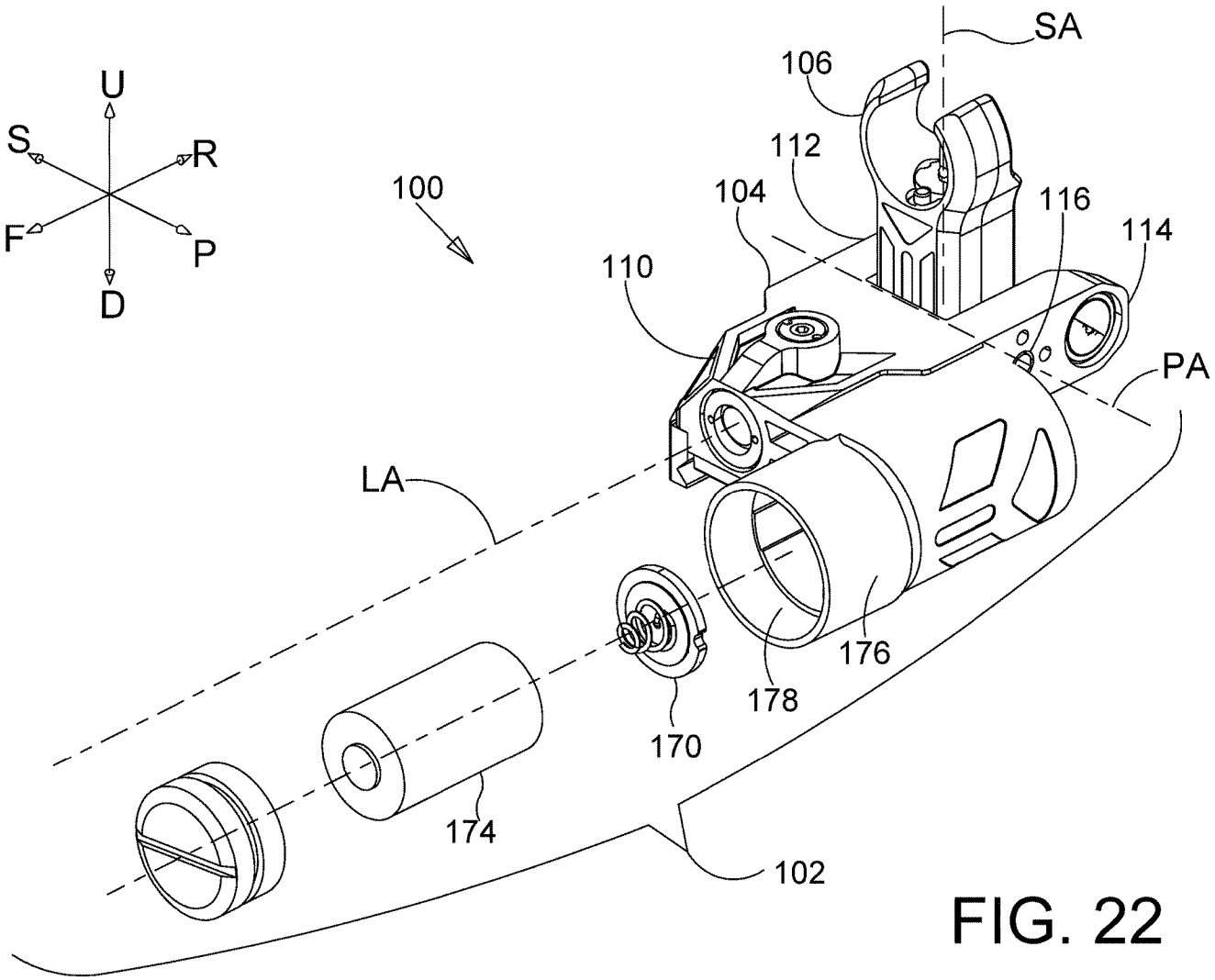
FIG. 22 is a partially exploded view showing a multi-function gunsight in accordance with the detailed description.

FIG. 19A and FIG. 19B are perspective views showing a multi-function gunsight 100 in accordance with this detailed description. FIG. 19A and FIG. 19B may be collectively referred to as FIG. 19. As shown in FIG. 19, the multi-function gunsight 100 comprises a gunsight assembly 102 including a body 104 and a sight arm 106 pivotally coupled to the body 104 for rotation between a stowed orientation and a deployed orientation. The body 104 supports a laser source that generates a laser beam.

The multi-function gunsight 100 includes a windage adjustment mechanism 142W and an elevation adjustment mechanism 142E that may allow the gunsight to be adjusted or sighted for a particular distance and wind condition. The windage adjustment mechanism 142W comprises a windage adjustment screw 146W that is threadingly received in a windage adjustment insert 148W. Rotation of the windage adjustment screw 146W relative to the windage adjustment insert 148W produces rotation of the laser source about a y-axis. The multi-function gunsight 100 also includes an elevation adjustment mechanism 142E comprising an elevation adjustment screw 146E that is threadingly received in an elevation adjustment insert 148E. Rotation of the elevation adjustment screw 146E relative to the elevation adjustment insert 148E produces rotation of the laser source about an x-axis.

The multi-function gunsight 100 comprises a starboard switch 152S and a port switch 152P. In the embodiment of FIG. 19, the starboard switch 152S is disposed in a starboard cavity 120 defined by the body 104 of the multi-function gunsight 100. The starboard switch 152S is positioned and configured to be actuated when a portwardly directed depressing force is applied to the starboard switch cap 160S. In the embodiment of FIG. 19, the port switch 152P is disposed in a port cavity 122 defined by the body 104 of the multi-function gunsight 100. The port switch 152P is positioned and configured to be actuated when a starboardly directed depressing force is applied to the port switch cap 160P.

Referring to FIGS. 1-25, a multi-function gunsight 100 for aiming a firearm 20 is disclosed. The firearm may have a barrel 22 defining a bore 24, the bore 24 extending along a gun bore axis BA. In the figures, the gun bore axis BA is shown extending in a forward direction and rearward direction. In one or more embodiments, the multi-function gunsight comprises a Y-shaped body having three legs, a forwardly extending leg 110 defining a laser cavity 108 and two rearwardly extending legs pivotally supporting a sight arm 106. The two rearwardly extending legs may include a port leg 114 and a starboard leg 112. A pin 116 may extend though the sight arm 106, the port leg 114 and the starboard leg 112. The sight arm 106 may be pivotally supported by the pin 116 so that the sight arm 106 pivots about a sight arm pivot axis PA between a deployed position and a reclined position.

A battery housing 176 multi-function gunsight 100 may be fixed to one of the lateral sides (port and starboard) of the Y-shaped body 104. The battery housing 176 defines a battery compartment 178 disposed on one lateral side (port or starboard) of the Y-shaped body in some embodiments. A windage adjustment mechanism 142W of the multi-function gunsight 100 may be positioned opposite the battery compartment 178. In some embodiments, the battery compartment 178 is disposed portward of the laser cavity 108 defined by the forwardly extending leg 110 of the body 104 and the windage adjustment mechanism 142W is disposed on a starboard side of the forwardly extending leg 110 of the body 104. In other embodiments, the battery compartment 178 is disposed starboard of the laser cavity 108 defined by the forwardly extending leg 110 of the body 104 and the windage adjustment mechanism 142W is disposed on a port side of the forwardly extending leg 110 of the body 104.

The battery compartment 178 may be dimensioned and adapted to receive a battery 174. In some embodiments, the battery compartment 178 is dimensioned and adapted to receive a battery 174 of the size known as CR123A. The battery 174 may comprise, for example, a CR123A lithium battery. In one or more embodiments, the battery compartment 178 is disposed forward of the sight arm pivot axis PA. In one or more embodiments, a forward-most end of the battery compartment 178 is disposed forward of a forward-most end of the laser cavity 108.

In one or more embodiments, a laser unit 134 of the multi-function gunsight 100 is disposed inside the laser cavity 108. The laser unit 134 may generate a laser beam extending in a forward direction along a laser beam axis LA. In one or more embodiments, the laser beam axis LA is generally parallel to the gun bore axis BA of the firearm 20. In one or more embodiments, the laser unit 134 is disposed forward of the sight arm pivot axis PA.

In one or more embodiments, a elevation adjustment mechanism 142E of the multi-function gunsight 100 is positioned opposite the battery compartment 178 and the battery housing 176. The elevation adjustment mechanism may selective rotate the laser unit 134 about a elevation axis X. In one or more embodiments, the elevation axis X extends in portward and starboard directions. In one or more embodiments, the elevation adjustment mechanism 142E is disposed forward of the sight arm pivot axis PA. In one or more embodiments, a windage adjustment mechanism 142W of the multi-function gunsight 100 is positioned opposite the battery compartment 178 and the battery housing 176. The windage adjustment mechanism may selective rotate the laser unit 134 about a windage axis Y. In one or more embodiments, the windage axis Y extends in upward and downward directions. In one or more embodiments, the windage adjustment mechanism 142W is disposed forward of the sight arm pivot axis PA.

In one or more embodiments, the sight arm 106 of the multi-function gunsight 100 comprises a sighting element 136 extending a along a sighting element axis SA. In one or more embodiments, the sighting element axis SA extends in the forward and rearward directions when the sight arm 106 is in the reclined position and the sighting element axis SA extends in the upward and downward directions when the sight arm 106 is in the deployed position. In one or more embodiments, the sighting element 136 is disposed rearward of the sight arm pivot axis PA when the sight arm 106 is in the reclined position and the sighting element 136 is disposed upward of the sight arm pivot axis PA when the sight arm 106 is in the deployed position. In one or more embodiments, the sighting element 136 is generally aligned with the sight arm pivot axis PA along an axis extending in forward and rearward directions when the sight arm 106 is in the deployed position. In one or more embodiments, the sighting element axis SA, the laser beam axis LA, and the gun bore axis BA are all generally coplanar when the sight arm 106 is in the reclined position. When the sight arm 106 is in the deployed position, the user may aim the firearm 20 with reference to a sight line SL extending through the sighting element 136. In one or more embodiments, the sight line SL, the laser beam axis LA, and the gun bore axis BA are all generally coplanar when the sight arm 106 is in the deployed position. In one or more embodiments, the sight line SL, the laser beam axis LA, and the gun bore axis BA are all generally parallel to each other when the sight arm 106 is in the deployed position. In one or more embodiments, the sighting element axis SA, the laser beam axis LA, and the gun bore axis BA are all generally parallel to each other when the sight arm 106 is in the reclined position.

Figure 6:
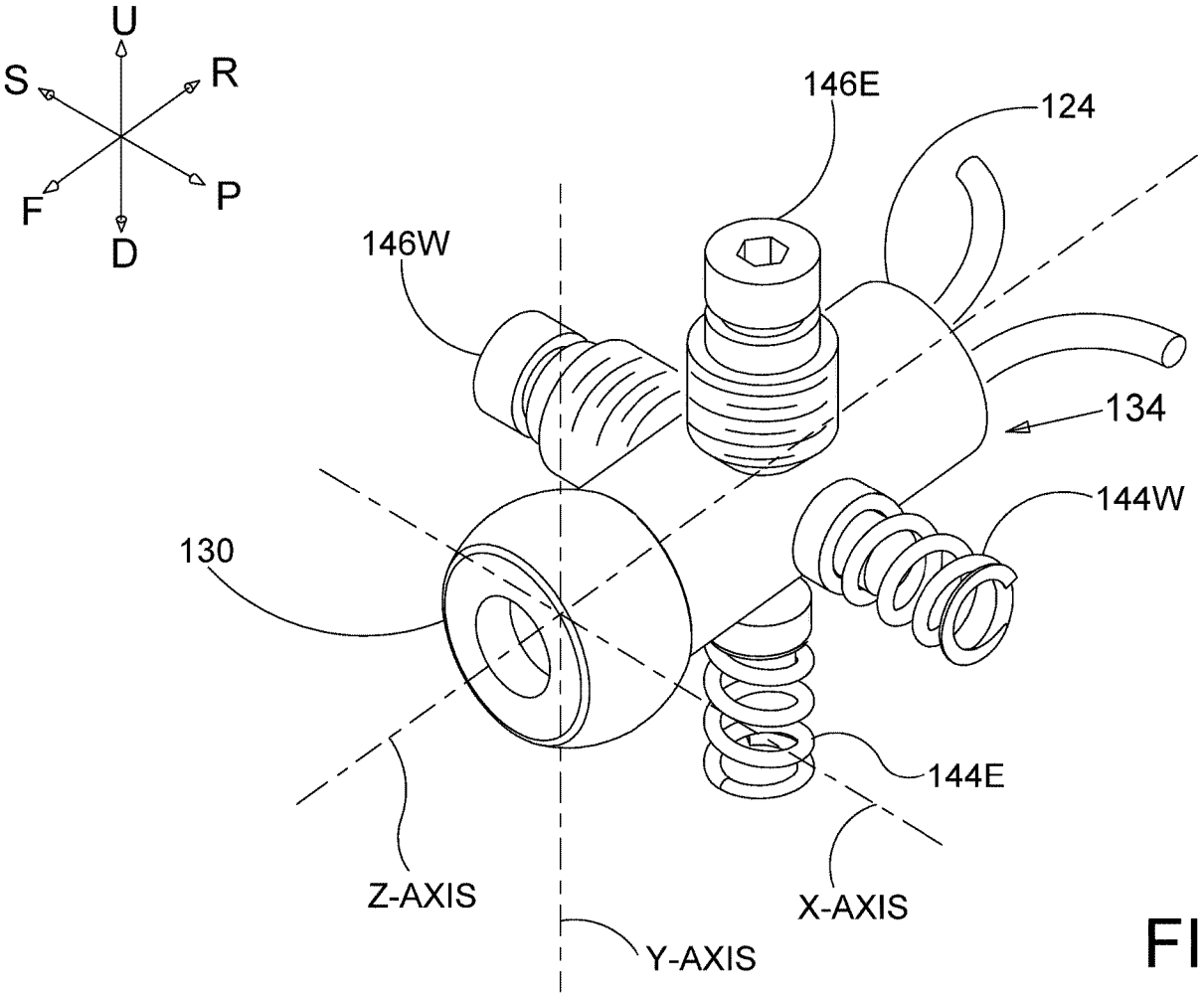
FIG. 6 is an enlarged perspective view further illustrating the multi-function gunsight shown in FIG. 4.
Figure 7:
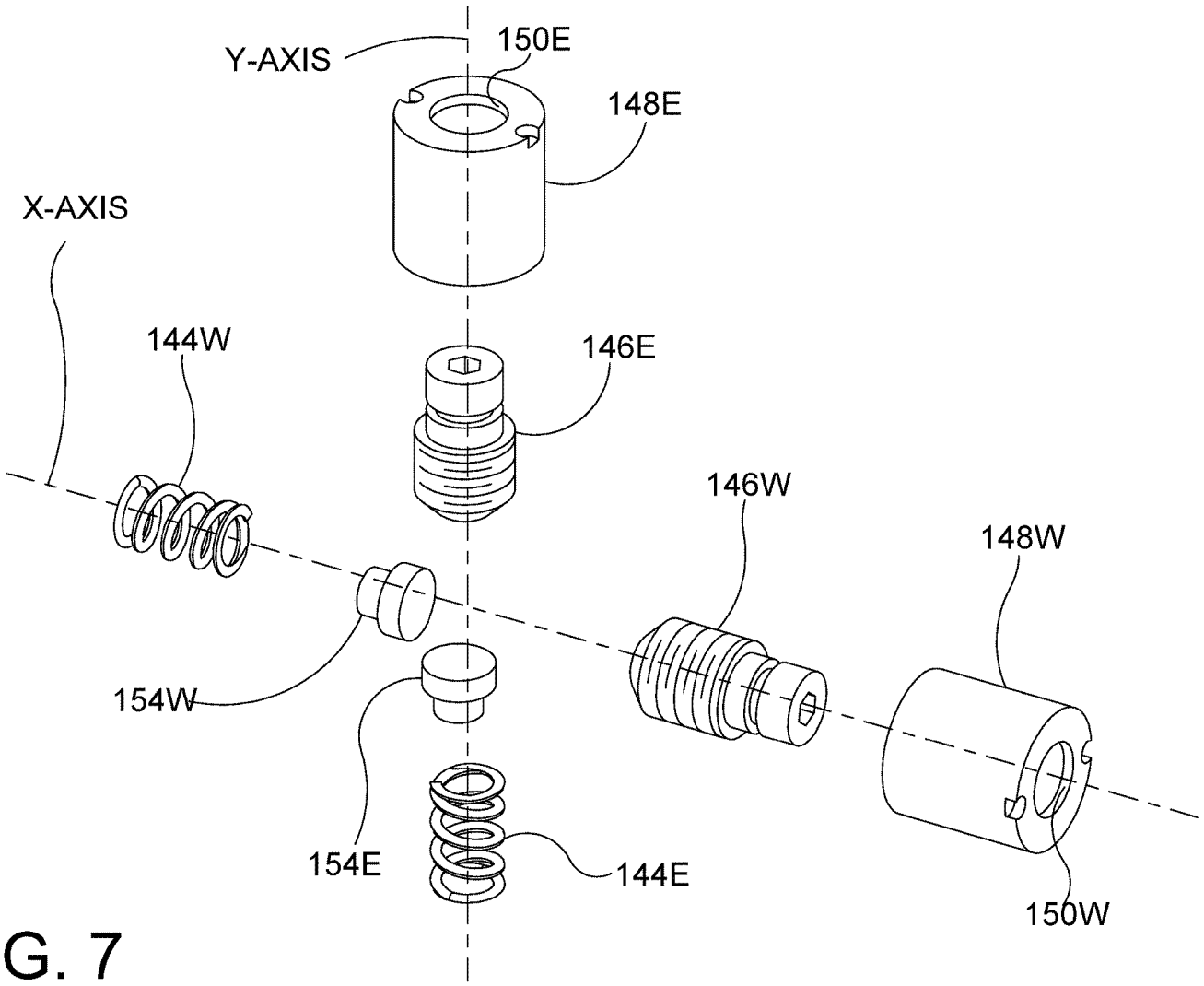
FIG. 7 is an enlarged exploded view further illustrating the multi-function gunsight shown in FIG. 4.
Figure 8:
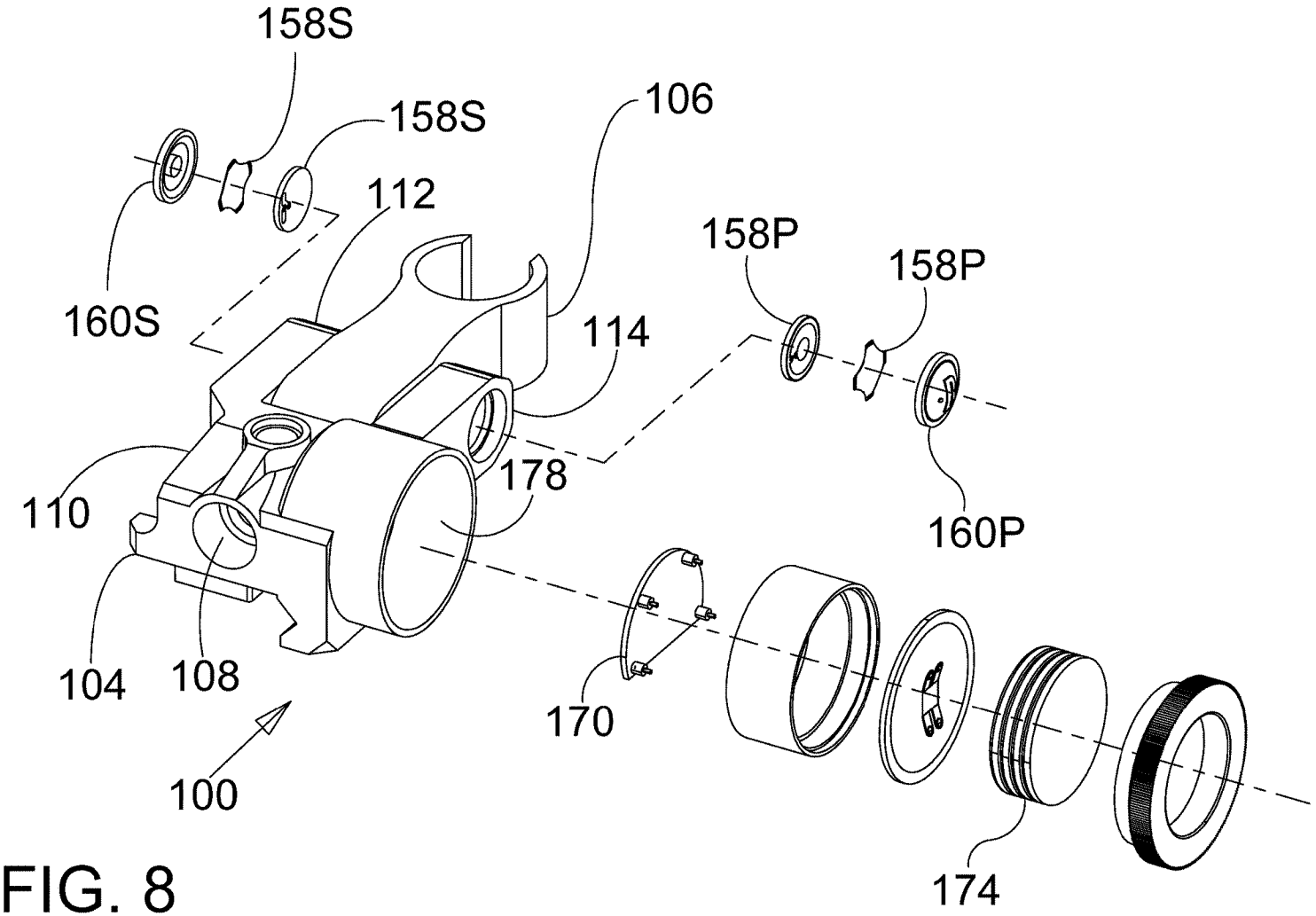
FIG. 8 is a partially exploded view showing a multi-function gunsight in accordance with the detailed description.
Figure 9:
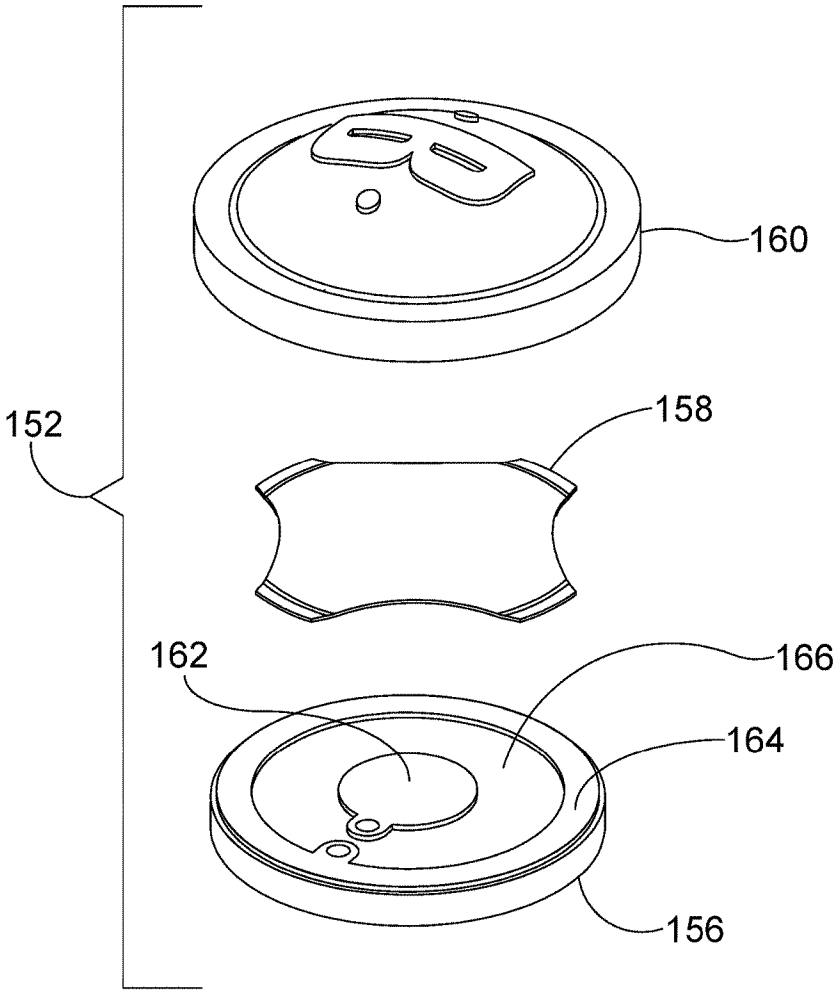
FIG. 9 is an enlarged exploded view further illustrating a switch in accordance with the detailed description.
Figure 10A:
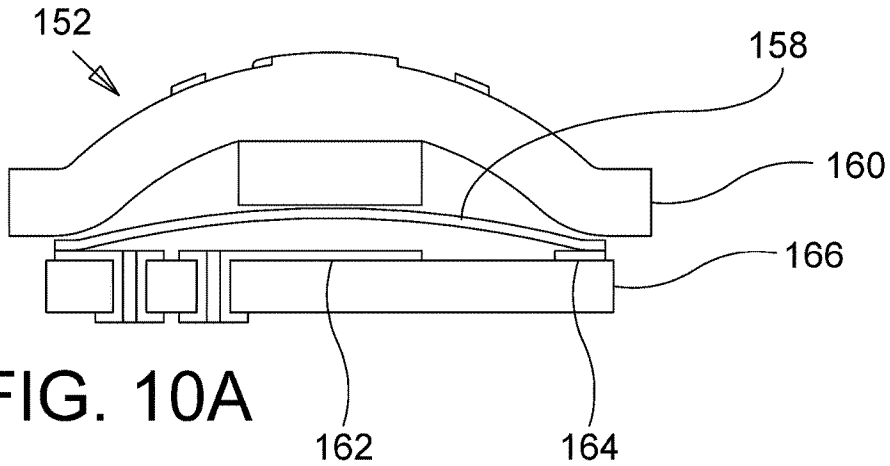
FIGS. 10A and 10B are enlarged cross-sectional views further illustrating a switch in accordance with the detailed description.
Figure 10B:
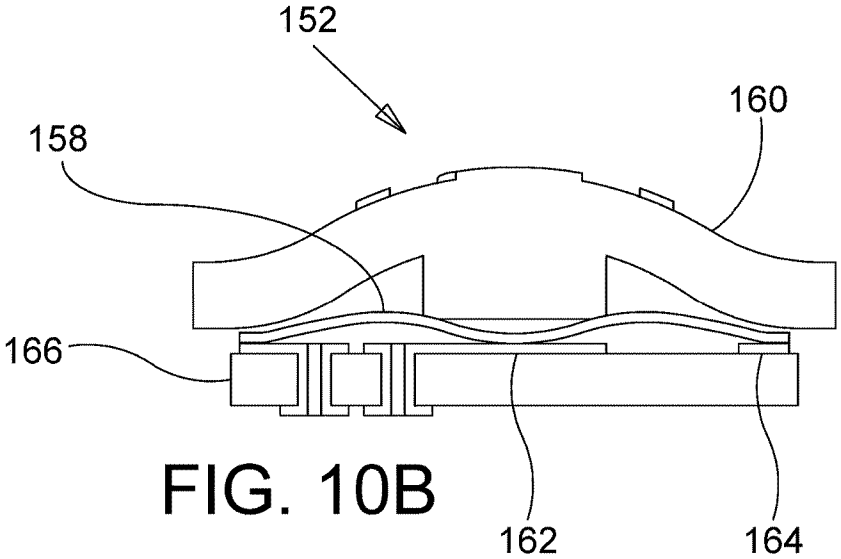

Referring to FIGS. 1-25, an upward direction U and a downward direction D are illustrated using arrows labeled "U" and "D." A forward direction F and a rearward direction R are illustrated using arrows labeled "F" and "R," respectively. A starboard direction S and a port direction P are illustrated using arrows labeled "S" and "P," respectively. With reference to FIG. 1, it will be appreciated that these directions may be conceptualized from the point of view of a user who is holding a firearm 20 with a gunsight mounted on the firearm 20. In FIG. 6, a Y-axis is shown extending in the upward and downward directions and an X-axis is shown extending in the starboard and portward directions. A Z-axis is shown extending in forward and reward directions in FIG. 6. The directions illustrated using these arrows and axes are applicable to the apparatus throughout this application. The port direction may also be referred to as the portward direction. In one or more embodiments, the upward direction is generally opposite the downward direction. In one or more embodiments, the upward direction and the downward direction are both generally orthogonal to an XZ plane defined by the forward direction and the starboard direction. In one or more embodiments, the forward direction is generally opposite the rearward direction. In one or more embodiments, the forward direction and the rearward direction are both generally orthogonal to an XY plane defined by the upward direction and the starboard direction. In one or more embodiments, the starboard direction is generally opposite the port direction. In one or more embodiments, starboard direction and the port direction are both generally orthogonal to a ZY plane defined by the upward direction and the forward direction. Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," "portwardly," and "starboard," should not be interpreted to limit the scope of the invention recited in the attached claims.

Figure 23:
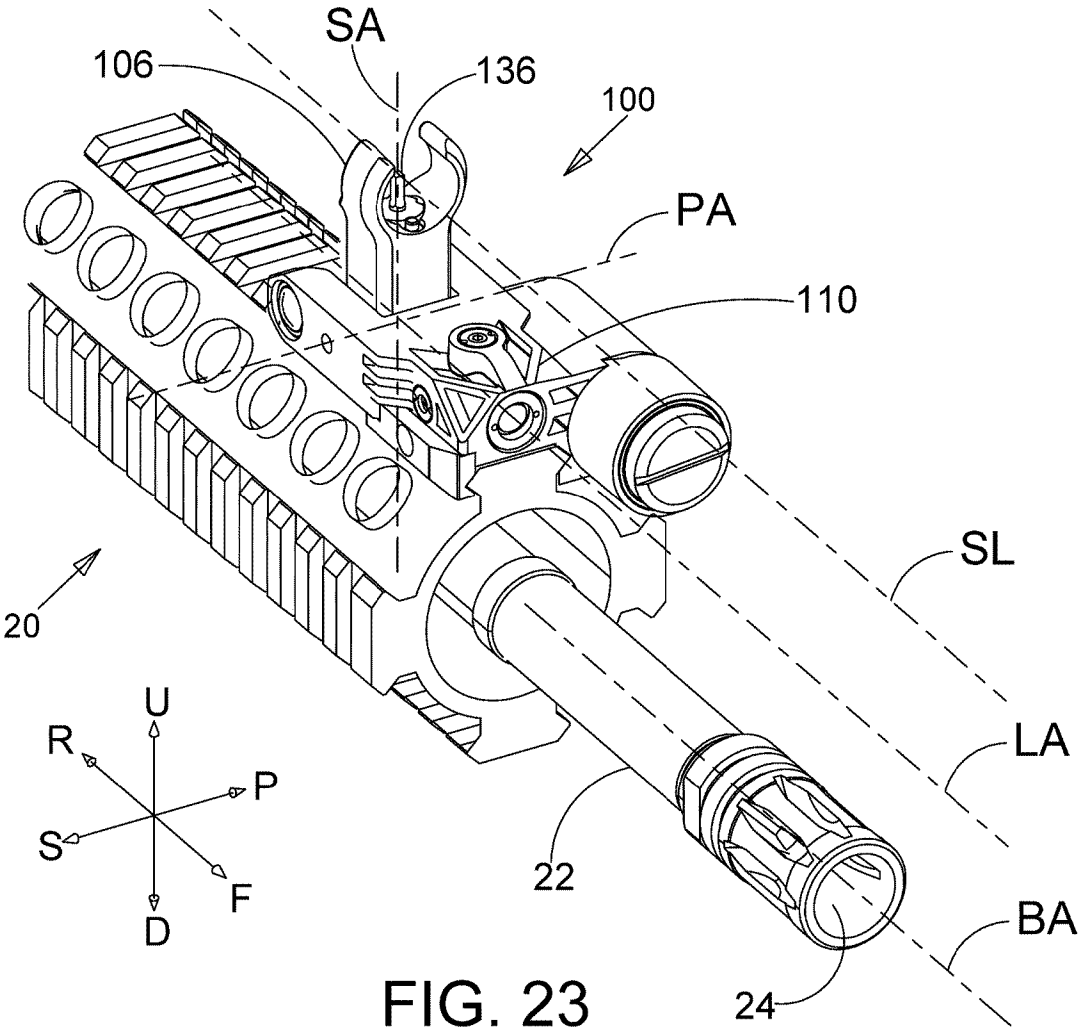
FIG. 23 is a perspective view showing a portion of a firearm and a multi-function gunsight mounted to the firearm.

FIG. 23 is a perspective view showing a portion of a firearm 20 and a multi-function gunsight 100 mounted to the firearm 20. The firearm has a barrel 22 defining a bore 24. The bore 24 extends along a gun bore axis BA. The gun bore axis BA extends in a forward direction and rearward direction. The multi-function gunsight 100 comprises a Y-shaped body having three legs, the three legs including a forwardly extending leg 110 defining a laser cavity and two rearwardly extending legs pivotally supporting a sight arm 106. The sight arm 106 pivots about a sight arm pivot axis PA between a deployed position and a reclined position. The sight arm pivot axis PA extends in a starboard direction and a portward direction. A laser unit is disposed inside the laser cavity defined by the forwardly extending leg 110 of the body 104. The laser unit selectively generates a laser beam extending in a forward direction along a laser beam axis LA. The sight arm 106 comprises a sighting element 136 extending along a sighting element axis SA. In the embodiment of FIG. 23, the sight arm 106 is in the deployed position. The sighting element 136 extends from a body portion of the sight arm 106 in the upward direction when the sight arm 106 is in the deployed position. The sighting element 136 extends from the sight arm 106 in a rearward direction when the sight arm 106 is in the reclined position. With reference to FIG. 23, it will be appreciated that the sighting element axis SA, the laser beam axis LA, and the gun bore axis BA are all generally coplanar. When the sight arm 106 is in the deployed position, the user may aim the firearm 20 with reference to a sight line SL extending through the sighting element 136. With reference to FIG. 23, it will be appreciated that the sight line SL, the laser beam axis LA, and the gun bore axis BA are all generally coplanar. With reference to FIG. 23, it will also be appreciated that the sight line SL, the laser beam axis LA, and the gun bore axis BA are all generally parallel in the embodiment shown. In some embodiments, the sighting element axis SA, the laser beam axis LA, and the gun bore axis BA are all generally parallel to each other when the sight arm 106 is in the reclined position.

Figure 24:
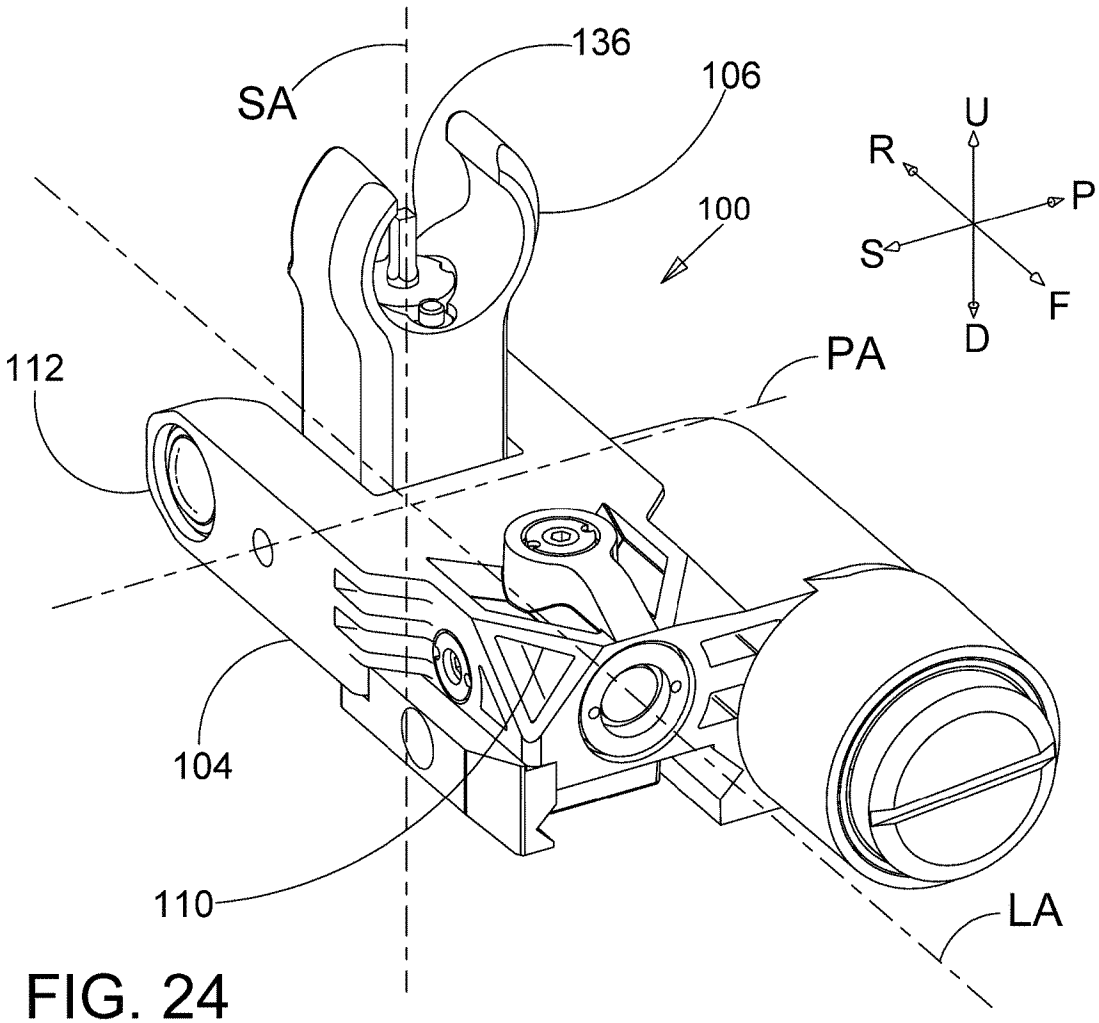
FIG. 24 is an enlarged perspective view further illustrating the multi-function gunsight shown in FIG. 23.

FIG. 24 is an enlarged perspective view showing the multi-function gunsight 100 of FIG. 23. The multi-function gunsight 100 comprises a Y-shaped body 104 having three legs, the three legs including a forwardly extending leg 110 defining a laser cavity and two rearwardly extending legs pivotally supporting a sight arm 106. The sight arm 106 pivots about a sight arm pivot axis PA between a deployed position and a reclined position. The sight arm pivot axis PA extends in a starboard direction and a portward direction. A laser unit is disposed inside the laser cavity defined by the forwardly extending leg 110 of the body 104. The laser unit selectively generates a laser beam extending in a forward direction along a laser beam axis LA. The sight arm 106 comprises a sighting element 136 extending along a sighting element axis SA. In the embodiment of FIG. 23, the sight arm 106 is in the deployed position. The sighting element 136 can be seen extending in an upward direction from a body portion of the sight arm 106 in FIG. 24.

Figure 25:
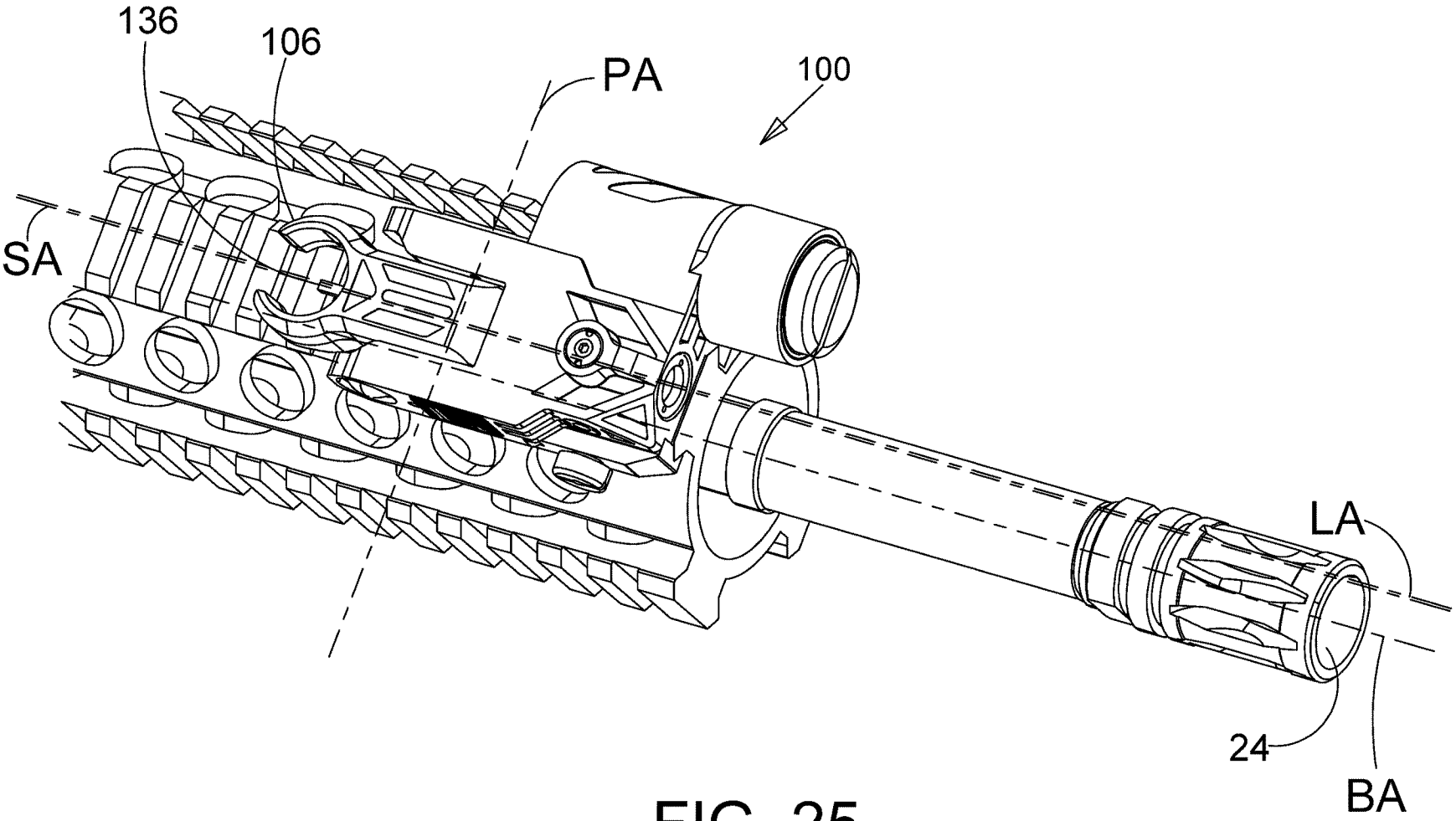
FIG. 25 is a perspective view showing a portion of a firearm and a multi-function gunsight mounted to the firearm.

FIG. 25 is a perspective view showing a portion of a firearm 20 and a multi-function gunsight 100 mounted to the firearm 20. The firearm has a barrel 22 defining a bore 24. The bore 24 extends along a gun bore axis BA. The gun bore axis BA extends in a forward direction and rearward direction. The multi-function gunsight 100 comprises a Y-shaped body having three legs, the three legs including a forwardly extending leg 110 defining a laser cavity and two rearwardly extending legs pivotally supporting a sight arm 106. The sight arm 106 pivots about a sight arm pivot axis PA between a deployed position and a reclined position. The sight arm pivot axis PA extends in a starboard direction and a portward direction. A laser unit is disposed inside the laser cavity defined by the forwardly extending leg 110 of the body 104. The laser unit selectively generates a laser beam extending in a forward direction along a laser beam axis LA. The sight arm 106 comprises a sighting element 136 extending along a sighting element axis SA. In the embodiment of FIG. 25, the sight arm 106 is a reclined or stowed position. The sighting element 136 extends from a body portion of the sight arm 106 in the rearward direction when the sight arm 106 is in the reclined or stowed position. With reference to FIG. 25, it will be appreciated that the sighting element axis SA, the laser beam axis LA, and the gun bore axis BA are all generally parallel in the embodiment shown. In some embodiments, the sighting element axis SA, the laser beam axis LA, and the gun bore axis BA are all generally parallel to each other when the sight arm 106 is in the reclined position. In some embodiments, the sighting element axis SA, the laser beam axis LA, and the gun bore axis BA are all generally coplanar.

The following United States patents are hereby incorporated by reference herein: U.S. Pat. Nos. 5,533,292, 5,918,374, 5,063,677, 8,037,634, 4,686,770, 8,015,744, 5,784,823, 5,584,569, 7,926,218, 7,472,830, 5,307,253, 5,193,099, 5,993,026, 5,343,376, 9,297,614, 5,838,639, 5,803,582, 5,791,766, and 6,066,052. The above references to U.S. patents in all sections of this application are herein incorporated by references in their entirety for all purposes. Components illustrated in such patents may be utilized with embodiments herein. Incorporation by reference is discussed, for example, in MPEP section 2163.07(B).

The above references in all sections of this application are herein incorporated by references in their entirety for all purposes. All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A multi-function gunsight for aiming a firearm, the firearm having a barrel defining a bore, the bore extending along a gun bore axis, the gun bore axis extending in a forward direction and rearward direction, the multi-function gunsight comprising:

a Y-shaped body having three legs, the three legs including a forwardly extending leg defining a laser cavity and two rearwardly extending legs pivotally supporting a sight arm, the sight arm pivoting about a sight arm pivot axis between a deployed position and a reclined position, the two rearwardly extending legs comprising starboard leg and a port leg;

a battery housing fixed to the Y-shaped body, the battery housing defining a battery compartment disposed on one lateral side of the Y-shaped body, the battery compartment being disposed forward of the sight arm pivot axis;

a laser unit disposed inside the laser cavity, the laser unit generating a laser beam extending in a forward direction along a laser beam axis, the laser beam axis being generally parallel to the gun bore axis of the firearm, the laser unit being disposed forward of the sight arm pivot axis;

a windage adjustment mechanism positioned opposite the battery cavity, the windage adjustment mechanism selectively rotating the laser unit about an windage axis, the windage axis extending in upward and downward directions, the windage adjustment mechanism being disposed forward of the sight arm pivot axis;

a forward-most end of the battery compartment being disposed forward of a forward-most end of the laser cavity;

the sight arm comprising a sighting element extending along a sighting element axis, the sighting element axis extending in the forward and rearward directions when the sight arm is in the reclined position, the sighting element axis extending in the upward and downward directions when the sight arm is in the deployed position, the sighting element being disposed rearward of the sight arm pivot axis when the sight arm is in the reclined position and the sighting element being disposed upward of the sight arm pivot axis when the sight arm is in the deployed position;

the sighting element axis, the laser beam axis, and the gun bore axis all being generally coplanar.

2. The gunsight of claim 1, wherein the laser unit comprises a laser housing, the laser housing supporting a semiconductor chip that emits laser light and a collimating lens that collimates the laser light emitted by the semiconductor chip, a forward end of the laser housing being coupled to a spherical bearing, the spherical bearing constraining movement of the laser housing in three translation degrees of freedom corresponding to translation along x, y, and z axes of an x-y-z coordinate system, the spherical bearing allowing rotation of the laser housing about at least the x and y axes of the x-y-z coordinate system, the spherical bearing comprising a spherical surface that is received in a cup.

3. The gunsight of claim 2, wherein the windage adjustment mechanism comprises a windage adjustment spring and a windage adjustment screw that is threadingly received in a windage adjustment insert, the windage adjustment insert including a windage adjustment shoulder positioned and configured to limit travel of the windage adjustment screw, the windage adjustment spring being positioned and configured to bias the laser housing against the windage adjustment screw, the windage adjustment screw being positioned and configured so that rotation of the windage adjustment screw relative to the windage adjustment insert produces rotation of the laser housing about the y-axis.

4. The gunsight of claim 3 further comprising an elevation adjustment mechanism comprising an elevation adjustment spring and an elevation adjustment screw that is threadingly received in an elevation adjustment insert, the elevation adjustment insert including an elevation adjustment shoulder positioned and configured to limit travel of the elevation adjustment screw, the elevation adjustment spring being positioned and configured to bias the laser housing against the elevation adjustment screw, the elevation adjustment screw being positioned and configured so that rotation of the elevation adjustment screw relative to the elevation adjustment insert produces rotation of the laser housing about the x-axis.

5. The gunsight of claim 1, further comprising a starboard switch disposed in a starboard cavity defined by the starboard leg of the Y-shaped body, the starboard cavity opening in a starboard direction, the switch assuming a closed circuit state while a portwardly directed depressing force is applied to the starboard switch.

6. The gunsight of claim 5, wherein the starboard switch comprises a starboard switch substrate overlaying a bottom surface of the starboard cavity, a starboard switch spring overlaying the starboard switch substrate, and the starboard switch cap overlaying the starboard switch spring, the starboard switch substrate comprising first and second conductive traces disposed on a starboard facing surface thereof, the starboard switch spring being deformable between an unstressed configuration in which an inner surface of the starboard switch spring is concave and a deformed configuration in which the starboard switch spring completes an electrical circuit between the first conductive trace and the second conductive trace of the starboard switch substrate, the starboard switch spring being positioned and configured to assume the deformed configuration when a portwardly directed depressing force is applied to the starboard switch cap.

7. The gunsight of claim 6, further comprising a port switch disposed in a port cavity defined by the port leg of the Y-shaped body, the port cavity opening in the port direction, the switch assuming a closed circuit state while a portwardly directed depressing force is applied to the port switch.

8. The gunsight of claim 7, wherein the port switch comprises a port switch substrate overlaying a bottom surface of the port cavity, a port switch spring overlaying the port switch substrate, and the port switch cap overlaying the port switch spring, the port switch substrate comprising first and second conductive traces disposed on a port facing surface thereof, the port switch spring being deformable between an unstressed configuration in which an inner surface of the port switch spring is concave and a deformed configuration in which the port switch spring completes an electrical circuit between the first conductive trace and the second conductive trace of the port switch substrate, the port switch spring being positioned and configured to assume the deformed configuration when a portwardly directed depressing force is applied to the port switch cap.

9. The gunsight of claim 5, wherein the starboard direction is generally orthogonal to a plane defined by the forward direction and the upward direction.

10. The gunsight of claim 5, wherein the upward direction is generally orthogonal to a plane defined by the forward direction and the starboard direction.

11. A multi-function gunsight for aiming a firearm, the firearm having a barrel defining a bore, the bore extending along a gun bore axis, the gun bore axis extending in a forward direction and rearward direction, the multi-function gunsight comprising:

a Y-shaped body having three legs, the three legs including a forwardly extending leg defining a laser cavity and two rearwardly extending legs pivotally supporting a sight arm, the sight arm pivoting about a sight arm pivot axis between a deployed position and a reclined position, the a sight arm pivot axis extending in a starboard direction and a portward direction, the two rearwardly extending legs comprising starboard leg and a port leg;

a battery housing fixed to the Y-shaped body, the battery housing defining a battery compartment disposed on one lateral side of the Y-shaped body, a rearward-most end of the battery compartment being disposed forward of the sight arm pivot axis;

a laser unit disposed inside the laser cavity, the laser unit generating a laser beam extending in a forward direction along a laser beam axis, a rearward-most end of the laser unit being disposed forward of the sight arm pivot axis;

a windage adjustment mechanism positioned opposite the battery cavity, the windage adjustment mechanism selectively rotating the laser unit about an windage axis, the windage axis extending in upward and downward directions, the windage axis being disposed forward of the sight arm pivot axis;

a forward-most end of the battery compartment being disposed forward of a forward-most end of the laser cavity;

the sight arm comprising a sighting element extending along a sighting element axis, the sighting element extending from a body portion of the sight arm in a rearward direction when the sight arm is in the reclined position, the rearward direction being opposite the forward direction, the sighting element extending from the body portion of the sight arm in the upward direction when the sight arm is in the deployed position;

the sighting element being disposed rearward of the sight arm pivot axis when the sight arm is in the reclined position and the sighting element being disposed upward of the sight arm pivot axis when the sight arm is in the deployed position;

the sighting element axis and the laser beam axis being generally coplanar.

12. The gunsight of claim 11, wherein the laser unit comprises a laser housing, the laser housing supporting a semiconductor chip that emits laser light and a collimating lens that collimates the laser light emitted by the semiconductor chip, a forward end of the laser housing being coupled to a spherical bearing, the spherical bearing constraining movement of the laser housing in three translation degrees of freedom corresponding to translation along x, y, and z axes of an x-y-z coordinate system, the spherical bearing allowing rotation of the laser housing about at least the x and y axes of the x-y-z coordinate system, the spherical bearing comprising a spherical surface that is received in a cup.

13. The gunsight of claim 12, wherein the windage adjustment mechanism comprises a windage adjustment spring and a windage adjustment screw that is threadingly received in a windage adjustment insert, the windage adjustment insert including a windage adjustment shoulder positioned and configured to limit travel of the windage adjustment screw, the windage adjustment spring being positioned and configured to bias the laser housing against the windage adjustment screw, the windage adjustment screw being positioned and configured so that rotation of the windage adjustment screw relative to the windage adjustment insert produces rotation of the laser housing about the y-axis.

14. The gunsight of claim 13 further comprising an elevation adjustment mechanism comprising an elevation adjustment spring and an elevation adjustment screw that is threadingly received in an elevation adjustment insert, the elevation adjustment insert including an elevation adjustment shoulder positioned and configured to limit travel of the elevation adjustment screw, the elevation adjustment spring being positioned and configured to bias the laser housing against the elevation adjustment screw, the elevation adjustment screw being positioned and configured so that rotation of the elevation adjustment screw relative to the elevation adjustment insert produces rotation of the laser housing about the x-axis.

15. The gunsight of claim 11, further comprising a starboard switch disposed in a starboard cavity defined by the starboard leg of the Y-shaped body, the starboard cavity opening in the starboard direction, the switch assuming a closed circuit state while a portwardly directed depressing force is applied to the starboard switch.

16. The gunsight of claim 15, wherein the starboard switch comprises a starboard switch substrate overlaying a bottom surface of the starboard cavity, a starboard switch spring overlaying the starboard switch substrate, and the starboard switch cap overlaying the starboard switch spring, the starboard switch substrate comprising first and second conductive traces disposed on a starboard facing surface thereof, the starboard switch spring being deformable between an unstressed configuration in which an inner surface of the starboard switch spring is concave and a deformed configuration in which the starboard switch spring completes an electrical circuit between the first conductive trace and the second conductive trace of the starboard switch substrate, the starboard switch spring being positioned and configured to assume the deformed configuration when a portwardly directed depressing force is applied to the starboard switch cap.

17. The gunsight of claim 16, further comprising a port switch disposed in a port cavity defined by the port leg of the Y-shaped body, the port cavity opening in the port direction, the switch assuming a closed circuit state while a portwardly directed depressing force is applied to the port switch.

18. The gunsight of claim 17, wherein the port switch comprises a port switch substrate overlaying a bottom surface of the port cavity, a port switch spring overlaying the port switch substrate, and the port switch cap overlaying the port switch spring, the port switch substrate comprising first and second conductive traces disposed on a port facing surface thereof, the port switch spring being deformable between an unstressed configuration in which an inner surface of the port switch spring is concave and a deformed configuration in which the port switch spring completes an electrical circuit between the first conductive trace and the second conductive trace of the port switch substrate, the port switch spring being positioned and configured to assume the deformed configuration when a portwardly directed depressing force is applied to the port switch cap.

19. The gunsight of claim 11, wherein the starboard direction is generally orthogonal to a plane defined by the forward direction and the upward direction.

20. A multi-function gunsight for aiming a firearm, the firearm having a barrel defining a bore, the bore extending along a gun bore axis, the gun bore axis extending in a forward direction and rearward direction, the multi-function gunsight comprising:

a Y-shaped body having three legs, the three legs including a forwardly extending leg defining a laser cavity and two rearwardly extending legs pivotally supporting a sight arm, the sight arm pivoting about a sight arm pivot axis between a deployed position and a reclined position, the a sight arm pivot axis extending in a starboard direction and a portward direction, the two rearwardly extending legs comprising starboard leg and a port leg;

a battery housing fixed to the Y-shaped body, the battery housing defining a battery compartment disposed on one lateral side of the Y-shaped body, a rearward-most end of the battery compartment being disposed forward of the sight arm pivot axis;

a laser unit disposed inside the laser cavity, the laser unit generating a laser beam extending in a forward direction along a laser beam axis, a rearward-most end of the laser unit being disposed forward of the sight arm pivot axis;

a windage adjustment mechanism positioned opposite the battery cavity, the windage adjustment mechanism selectively rotating the laser unit about an windage axis, the windage axis extending in upward and downward directions, the windage axis being disposed forward of the sight arm pivot axis;

a forward-most end of the battery compartment being disposed forward of a forward-most end of the laser cavity;

the sight arm comprising a sighting element extending along a sighting element axis, the sighting element extending from a body portion of the sight arm in a rearward direction when the sight arm is in the reclined position, the rearward direction being opposite the forward direction, the sighting element extending from the body portion of the sight arm in the upward direction when the sight arm is in the deployed position;

the sighting element being disposed rearward of the sight arm pivot axis when the sight arm is in the reclined position and the sighting element being disposed upward of the sight arm pivot axis when the sight arm is in the deployed position;

the sighting element axis and the laser beam axis being generally coplanar;

wherein the laser unit comprises a laser housing, the laser housing supporting a semiconductor chip that emits laser light and a collimating lens that collimates the laser light emitted by the semiconductor chip, a forward end of the laser housing being coupled to a spherical bearing, the spherical bearing constraining movement of the laser housing in three translation degrees of freedom corresponding to translation along x, y, and z axes of an x-y-z coordinate system, the spherical bearing allowing rotation of the laser housing about at least the x and y axes of the x-y-z coordinate system, the spherical bearing comprising a spherical surface that is received in a cup;

wherein the windage adjustment mechanism comprises a windage adjustment spring and a windage adjustment screw that is threadingly received in a windage adjustment insert, the windage adjustment insert including a windage adjustment shoulder positioned and configured to limit travel of the windage adjustment screw, the windage adjustment spring being positioned and configured to bias the laser housing against the windage adjustment screw, the windage adjustment screw being positioned and configured so that rotation of the windage adjustment screw relative to the windage adjustment insert produces rotation of the laser housing about the y-axis;

an elevation adjustment mechanism comprising an elevation adjustment spring and an elevation adjustment screw that is threadingly received in an elevation adjustment insert, the elevation adjustment insert including an elevation adjustment shoulder positioned and configured to limit travel of the elevation adjustment screw, the elevation adjustment spring being positioned and configured to bias the laser housing against the elevation adjustment screw, the elevation adjustment screw being positioned and configured so that rotation of the elevation adjustment screw relative to the elevation adjustment insert produces rotation of the laser housing about the x-axis;

a starboard switch disposed in a starboard cavity defined by the starboard leg of the Y-shaped body, the starboard cavity opening in the starboard direction, the switch assuming a closed circuit state while a portwardly directed depressing force is applied to the starboard switch; and a port switch disposed in a port cavity defined by the port leg of the Y-shaped body, the port cavity opening in the port direction, the switch assuming a closed circuit state while a portwardly directed depressing force is applied to the port switch.

* * * * *